US006415712B1

(12) United States Patent
Helland et al.

(10) Patent No.: US 6,415,712 B1
(45) Date of Patent: Jul. 9, 2002

(54) TRACK MECHANSIM FOR GUIDING FLEXIBLE STRAPS AROUND BUNDLES OF OBJECTS

(75) Inventors: Gary Helland, Elma; Rich Ballou, Hoquiam; Marla Greenlund, Montesano; Don Smith, Aberdeen, all of WA (US)

(73) Assignee: Enterprises International, Inc., Hoquiam, WA (US)

( * ) Notice: Subject to any disclaimer, the term of this patent is extended or adjusted under 35 U.S.C. 154(b) by 0 days.

(21) Appl. No.: 09/454,912

(22) Filed: Dec. 2, 1999

(51) Int. Cl.[7] ..... B65B 13/04
(52) U.S. Cl. ..... 100/26; 53/589
(58) Field of Search ..... 100/25, 26; 53/589

(56) References Cited

U.S. PATENT DOCUMENTS

| | | | | |
|---|---|---|---|---|
| 3,118,368 A | * | 1/1964 | Lems | 100/26 |
| 3,179,037 A | | 4/1965 | Cranston, Jr. et al. | |
| 3,447,448 A | | 6/1969 | Pasic | |
| 3,768,396 A | | 10/1973 | Coleman | |
| 3,884,139 A | | 5/1975 | Pasic | |
| 4,011,808 A | | 3/1977 | Aoki et al. | |
| 4,120,239 A | | 10/1978 | Pasic et al. | |
| 4,155,799 A | | 5/1979 | Matsushita et al. | |
| 4,244,773 A | * | 1/1981 | Siebeck et al. | 100/26 X |
| 4,278,014 A | | 7/1981 | Knieps | |
| 4,387,631 A | | 6/1983 | Pasic | |
| 4,516,488 A | | 5/1985 | Bartzick et al. | |

(List continued on next page.)

FOREIGN PATENT DOCUMENTS

| | | |
|---|---|---|
| DE | 38 41 884 A1 | 6/1990 |
| DE | 287 152 A7 | 2/1991 |
| DE | 44 21 661 A1 | 1/1996 |
| EP | 0 695 687 A2 | 2/1996 |
| FR | 2 615 480 A | 11/1988 |
| GB | 2 226 427 A | 6/1990 |
| JP | 8011816 A | 1/1996 |
| WO | WO 95/10452 | 4/1995 |
| WO | WO 98/22348 | 5/1998 |

*Primary Examiner*—Stephen F. Gerrity
(74) *Attorney, Agent, or Firm*—Seed IP Law Group; Michael J. Donohue

(57) ABSTRACT

Apparatus and methods for applying flexible straps around objects including a feed and tension unit, a feed drive wheel and a feed pinch wheel, a primary tension drive wheel and a primary tension pinch wheel, and a secondary tension drive wheel and a secondary tension pinch wheel, wherein at least one of the pinch wheels is controllably biased against the respective drive wheel by a solenoid that is controlled in two stages: a first stage that provides a full feed or tensioning force and a second stage that provides a reduced feed or tensioning force by altering the pulse width modulation of the solenoid. In another embodiment, the three sets of wheels of the feed and tension unit are configured to provide a simplified "V-shaped" strap path that reduces bending of the strap, thereby reducing friction and consequent feeding difficulties. In another embodiment, the feed and tension unit includes inner and outer guides that form a strap channel through the feed and tension unit to provide easy access to the strap path for clearing the strap path in the event of a jam. In another embodiment, a track assembly includes a plurality of sections providing modularity of construction. Each section includes a backplate attached to at least one support member, and a slotted cover pivotably attached to the at least one support member proximate the backplate and moveable between an open position spaced apart from the backplate and a closed position proximate the backplate. In another embodiment, a cutting assembly for severing strap material includes a press platen and a cutter having a first cutting blade along a first edge thereof and a second cutting blade along a second edge thereof, the cutter being removably and variably engaged to the press platen.

13 Claims, 18 Drawing Sheets

U.S. PATENT DOCUMENTS

| | | | | | |
|---|---|---|---|---|---|
| 4,520,720 | A | | 6/1985 | Urban et al. | |
| 4,569,186 | A | | 2/1986 | Mori et al. | |
| 4,625,635 | A | | 12/1986 | Lewis | |
| 4,697,510 | A | | 10/1987 | Cranston, III et al. | |
| 4,712,357 | A | | 12/1987 | Crawford et al. | |
| 4,724,659 | A | | 2/1988 | Mori et al. | |
| 4,781,110 | A | | 11/1988 | Sakaki et al. | |
| 4,867,053 | A | | 9/1989 | Kawai et al. | |
| 4,955,180 | A | | 9/1990 | Sakaki et al. | |
| 5,146,847 | A | | 9/1992 | Lyon et al. | |
| 5,187,656 | A | | 2/1993 | Kurakake | |
| 5,251,544 | A | * | 10/1993 | Abrams | 100/26 |
| 5,287,802 | A | | 2/1994 | Pearson | |
| 5,379,576 | A | | 1/1995 | Koyama | |
| 5,414,980 | A | | 5/1995 | Shibazaki et al. | |
| 5,560,187 | A | | 10/1996 | Nagashima et al. | |
| 5,613,432 | A | | 3/1997 | Hoshino | |
| 5,778,772 | A | * | 7/1998 | Schwede | 100/26 |
| 5,809,873 | A | | 9/1998 | Chak et al | |

* cited by examiner .

TRACK MECHANSIM FOR GUIDING FLEXIBLE STRAPS AROUND BUNDLES OF OBJECTS

TECHNICAL FIELD

This invention relates to apparatus and methods for applying flexible straps around bundles of objects.

BACKGROUND OF THE INVENTION

Many high-speed, automatic strapping machines have been developed, such as those disclosed in U.S. Pat. Nos. 3,735,555; 3,884,139; 4,120,239; 4,312,266; 4,196,663; 4,201,127; 3,447,448; 4,387,631; 4,473,005; 4,724,659, 5,379,576, 5,414,980, 5,613,432, and 5,809,873. As disclosed by the devices in these patents, a conveyor belt typically conveys a bundle at high speed to a strapping station where straps are automatically applied before the conveyor belt moves the strapped bundle away from the device.

Typical strapping machines employ an initial or primary tensioning apparatus that provides an initial tensioning of the strap about the bundle. A secondary tensioning apparatus thereafter provides increased or enhanced tension of the strap. A sealing head then seals the strap, typically through the use of a heated knife mechanism, to complete the bundling operation.

FIG. 1 is a strapping machine 100 in accordance with the prior art, as shown and described in U.S. Pat. No. 5,414,980, issued to Shibazaki et al. The strapping machine 100 includes the following major components, all mounted to a housing or frame 110: a strap dispenser 112, an accumulator 114, a feed and tension unit 116, a track 118, a sealing head 122, and a control system 124. In addition, some devices also have a secondary tension unit 120 (not shown), such as the type disclosed in U.S. Pat. No. 3,552,305 issued to Dorney et al. The basic operation of the machine involves a feeding cycle and a strapping cycle. In the feeding cycle, strap is pulled from a strap coil mounted on the dispenser 112 by a feed and tension motor and is fed through the accumulator 114, the feed and tension unit 116, the sealing head 122, and the track 118. After the strap has been fed around the track 118 and back into the sealing head 122, the strapping cycle begins.

During the strapping cycle, the strapping machine performs several functions. First, the sealing head 122 of the strapping machine grips the free end of the strap, holding it securely. Next, in a primary tensioning sequence, a track guide mechanically opens and the strap is pulled from the track 118 as the strap is drawn around the bundle by a feed and tension motor.

As the primary tensioning sequence is completed, additional strap tension may be applied by the secondary tension unit 120. As this secondary tensioning process is completed, the sealing head 122 grips the supply side of the strap. The overlapping strap sections are then heated by a heater blade, pressed together by a press platen, and severed from the supply by a strap cutter 140.

Following the sealing process, the strap path through the sealing head 122 is once again aligned and the feeding sequence can begin. The sealing head 122 continues to rotate allowing the seal to cool while the feeding sequence continues. At the end of the strapping cycle, the sealed strap is released and the strapping machine 100 is ready to repeat the feeding cycle.

Although desirable results are achievable using the prior art strapping machines 100, some operational drawbacks exist. For example, the prior art feed and tension unit 116 typically includes a complicated series of strap guides. The strap must be fed through the strap guides, undergoing several bends and turns between the dispenser 112 and the sealing head 122. Existing strapping machines typically turn the strap through a total of 360 degrees or more before reaching the track. The bends and turns in the strap path may induce kinks in the strap that may subsequently lead to feeding difficulties. If the strap becomes jammed in the feed and tension unit 116, the process of clearing the strap path from the complicated series of strap guides may be time-consuming and may require machine downtime.

Another disadvantage of the prior art strapping machines is that the drive assemblies of the sealing head 122 and the feed and tension unit 120 are typically complicated designs featuring a one or more gear boxes. Often these gear boxes are complicated and must transfer the drive forces through a 90 degree angle. Generally, the cost of fabricating the drive assembly increases with the design complexity, adding to the ultimate cost of the strapping machine.

SUMMARY OF THE INVENTION

The present invention improves upon prior strapping devices, and provides additional benefits, such as by providing variability in the apparatus that can be easily altered to fit various production and package requirements and by employing a control system that monitors operating signals and transmits control signals accordingly.

A feed and tension unit under one aspect of the invention includes three sets of wheels: (1) a feeding set including a feed drive roller and a feed pinch roller, (2) a primary tensioning set including a primary tension drive roller and a primary tension pinch roller, and (3) a secondary tensioning set including a secondary tension drive roller and a secondary tension pinch roller, and wherein at least one of the feed pinch roller, the primary tension pinch roller, or the secondary tension pinch roller is coupled to a solenoid that controllably biases the pinch roller against the respective drive roller based on a pinch signal supplied to the solenoid, the pinch signal having a first pulse width modulated stage that provides a full pinch force and a second pulse width modulated stage that provides a reduced pinch force.

During a primary tensioning operation, a control system monitors position signals from a feed pinch roller position sensor and terminates primary tensioning when a slippage condition is determined. The control system then initiates a secondary tensioning operation. The secondary tensioning operation lasts for a predetermined amount of time, then the control system initiates a joining operation that secures the strap around the bundle.

In another aspect of the invention, the three sets of wheels or rollers of the feed and tension unit are configured to provide a simplified strap path that reduces bending of the strap, thereby reducing friction and consequent feeding difficulties. Alternately, the drive wheels of the feed and tension unit may be positioned on the side of the strap opposite from the bundle to reduce adverse effects of debris from the bundle. In another aspect, the feed and tension unit includes inner and outer guides that form a strap channel through the feed and tension unit. The inner and outer guides are configured to provide easy access to the strap path for clearing the strap path in the event of a jam.

In a further aspect of the invention, a strap material accumulating compartment includes a first sidewall having a plurality of mounting posts projecting therefrom, each mounting post having a plurality of mounting holes disposed therethrough, a second sidewall having a plurality of mounting apertures alignable with and slideably engageable with, the mounting posts, and a plurality of pin holders positioned proximate the mounting apertures, and a plurality of mounting pins removably and adjustably engageable with the mounting holes and the pin holders. The first and second sidewalls approximately form a chamber therebetween wherein the strap may accumulate. The width of the chamber may be adjusted easily and quickly to accommodate varying widths of strap by removal of the retaining pins, repositioning the second sidewall at the desired location, and replacement of the retaining pins within the desired holes.

In yet another aspect of the invention, the track assembly includes a plurality of sections providing modularity of construction. Each section includes a backplate attached to at least one support member, and a slotted cover pivotably attached to the at least one support member proximate the backplate and moveable between an open position spaced apart from the backplate and a closed position proximate the backplate, and a biasing member engaged with the slotted cover that exerts a biasing force on the slotted cover to urge the slotted cover toward the closed position. The biasing force is small enough that a tensioning force in the strap material may overcome the biasing force and thereby actuate the slotted cover toward the open position to allow the strap material to escape from the guide passage during a tension cycle. During a feed cycle, the strap material exerts a closing force on an outer surface of the slotted cover, urging the slotted cover into the closed position. In another aspect, the slotted covers are pivotably mounted on guide pins that are approximately parallel to the path of the strap material within the guide passage.

In another aspect, a cutting assembly for severing strap material includes a press platen and a cutter having a first cutting blade along a first edge thereof and a second cutting blade along a second edge thereof, the cutter being removably and variably engaged to the press platen such that at least one of the first or second cutting blades is engageable with the strap material. In another aspect, at least one of the first and second edges is slanted at a slant angle with respect to an adjacent edge of the cutter.

These and other benefits of the present invention will become apparent to those skilled in the art based on the following detailed description.

BRIEF DESCRIPTION OF THE DRAWINGS

In the drawings, identical reference numbers identify identical or substantially similar elements or steps.

DETAILED DESCRIPTION OF THE INVENTION

The present disclosure is directed toward apparatus and methods for strapping bundles of objects. Specific details of certain embodiments of the invention are set forth in the following description, and in FIGS. 2–25, to provide a thorough understanding of such embodiments. A person of ordinary skill in the art, however, will understand that the present invention may have additional embodiments, and that the invention may be practiced without several of the details described in the following description.

Figure 1:
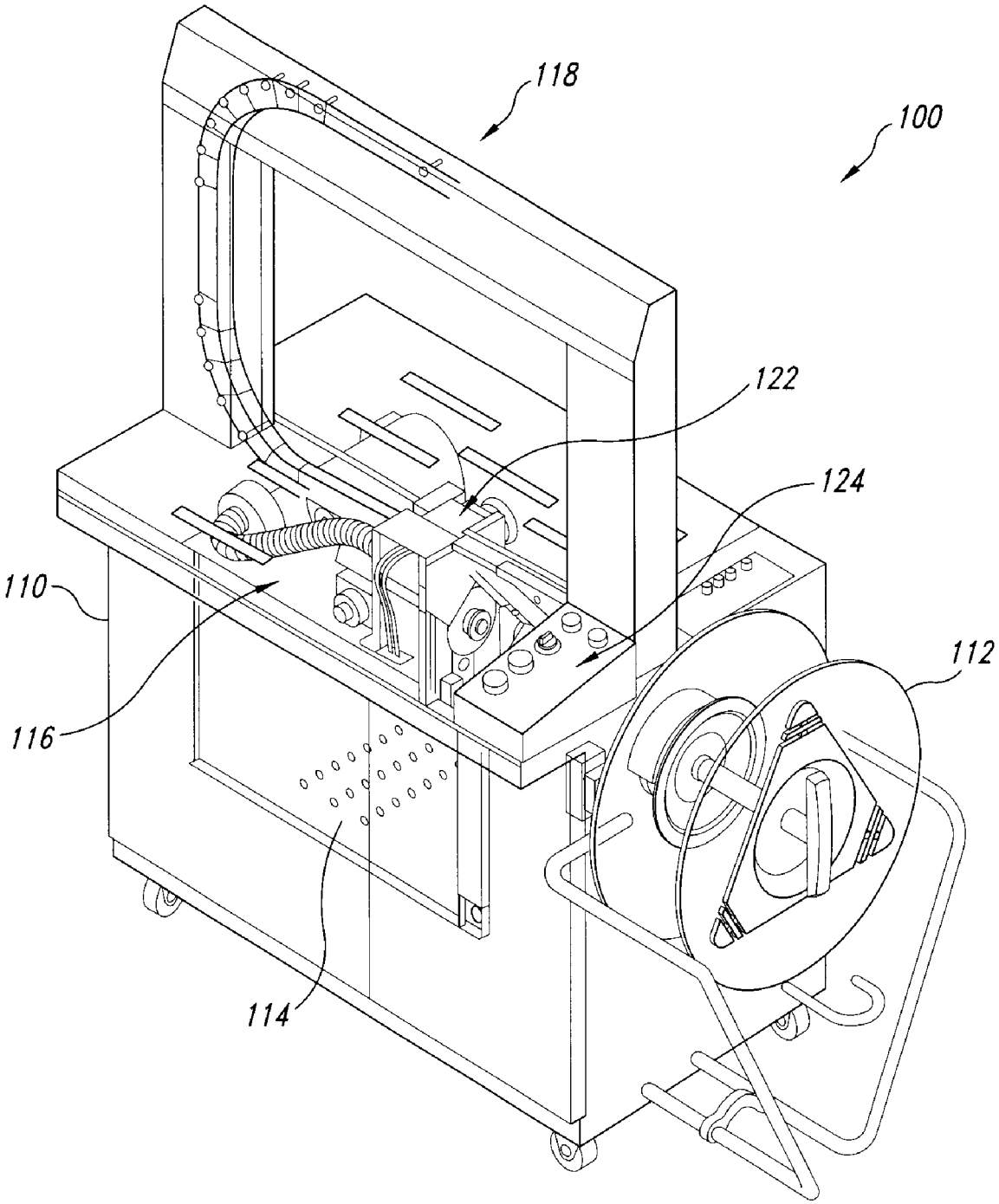
Fig. 1 (Prior Art)
FIG. 1 is a front elevational view and partial fragmentary view of a strapping machine under the prior art.
Figure 2:
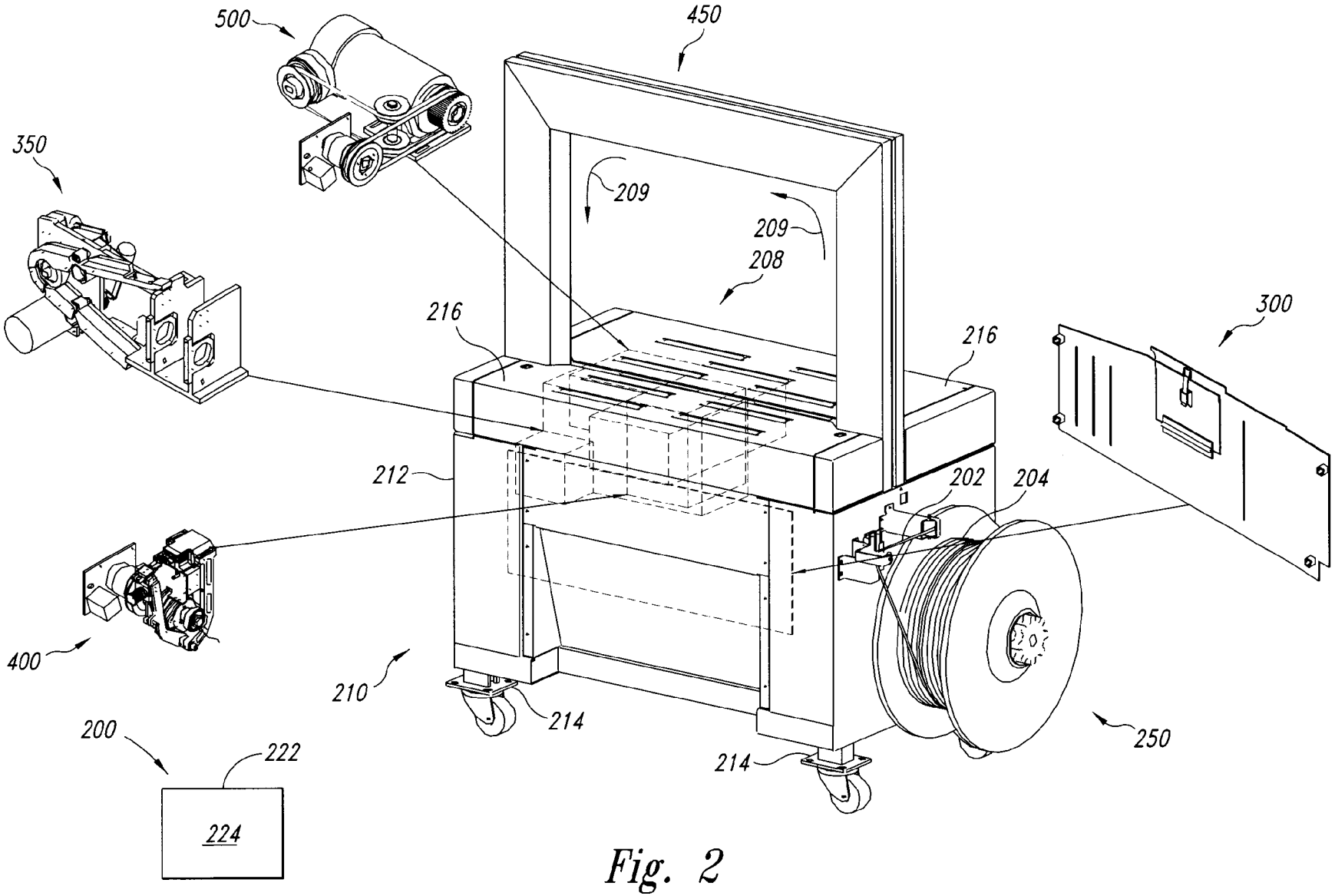
FIG. 2 is an isometric view of a strapping machine in accordance with an embodiment of the invention.

FIG. 2 is an isometric view of a strapping machine 200 in accordance with an embodiment of the invention. The strapping machine 200 includes seven major subassemblies: a frame 210, a control system 220, a dispenser 250, an accumulator 300, a feed and tension unit 350, a sealing head 400, a drive assembly 500, and a track 450. The subassemblies are of modular construction, which allows them to be used in multiple frame configurations.

Throughout the following discussion and in the accompanying figures, the strap material is shown and referred to as a particular type of material, namely, a flat, two-sided, tape-shaped strip of material. This practice is adopted herein solely for the purpose of simplifying the description of the inventive methods and apparatus. It should be understood, however, that several of the methods and apparatus disclosed herein may be equally applicable to various types of strap material, and not just to the flat, two-sided, tape-shaped material shown in the figures. Thus, as used herein, the terms "strap" and "strap material" should be understood to include all types of materials used to bundle objects.

Figure 18:
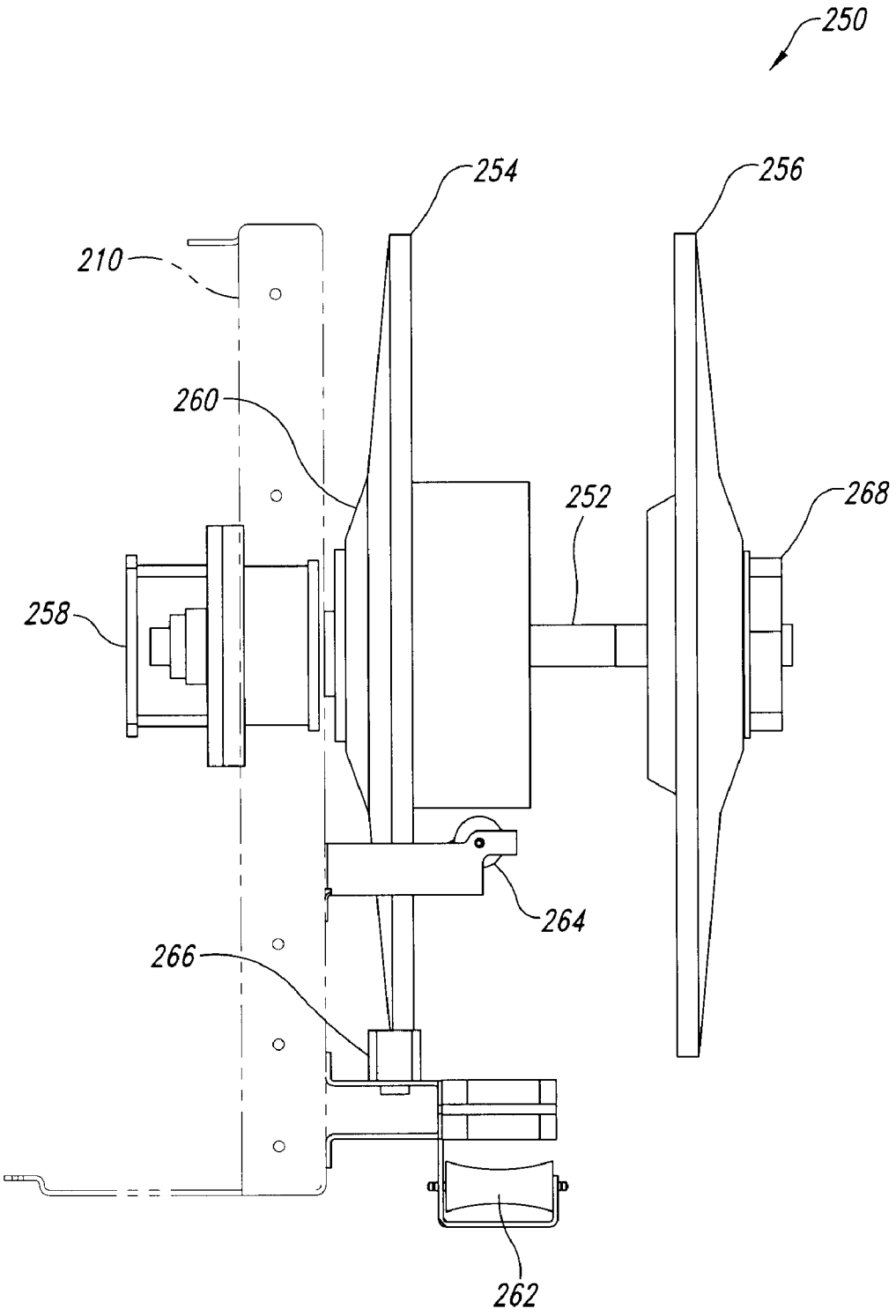
FIG. 18 is a top elevational view of the dispenser of FIG. 17.
Figure 19:
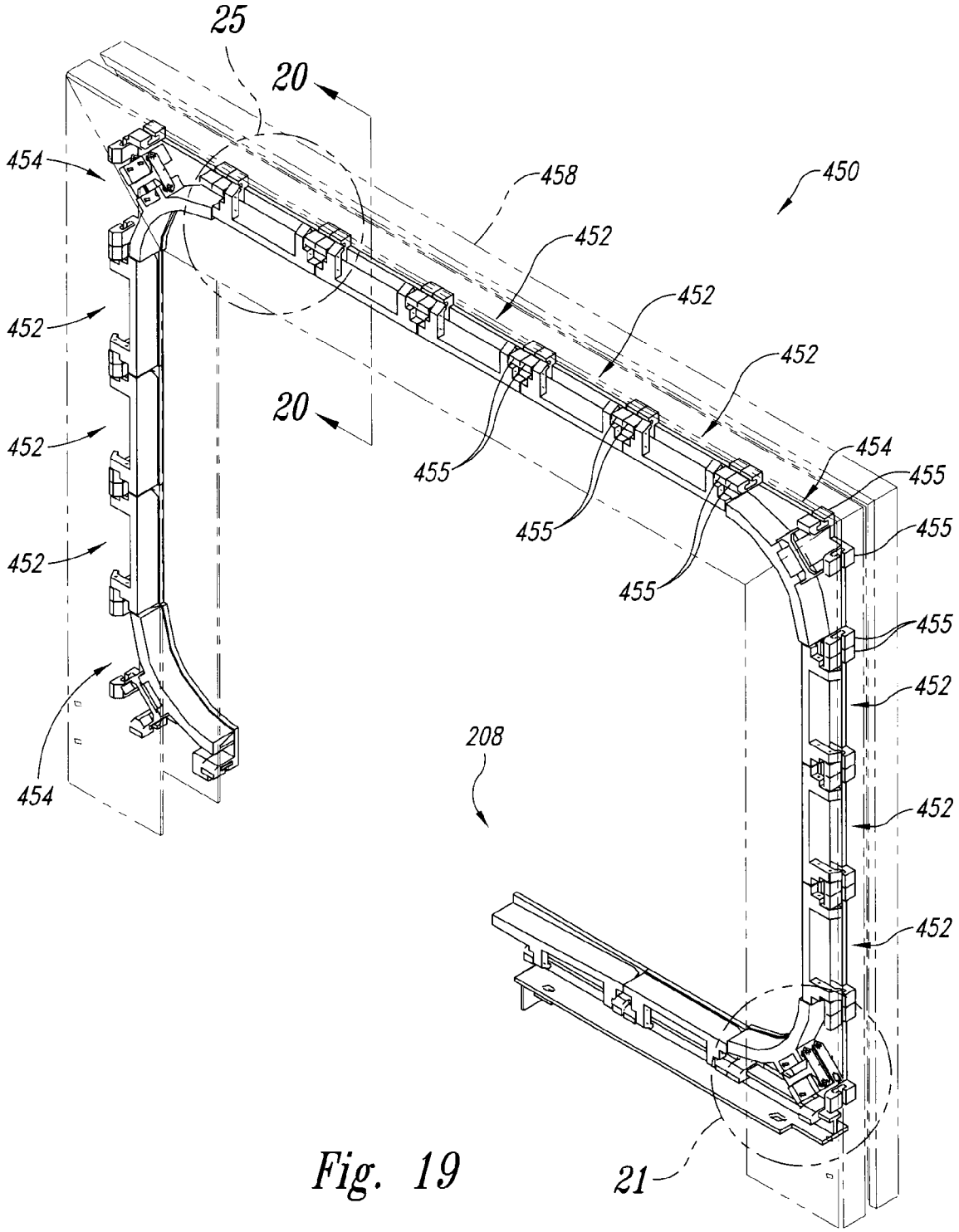
FIG. 19 is an isometric view of a track in accordance with an embodiment of the invention.
Figure 20:
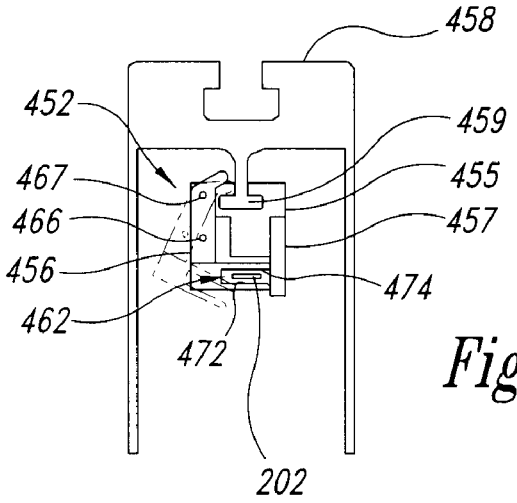
FIG. 20 is a partial sectional view of a straight section of the track of FIG. 19 taken along line 20—20.

The overall operation of the strapping machine 200 will first be described with reference to various figures, and thereafter, the individual components will be described in detail. In brief, the operation of the strapping machine 200 involves paying off strap 202 from a strap coil 204 located on the dispenser 250 (FIGS. 17–18), and feeding a free end 206 of the strap 202 through the accumulator 300 (FIGS. 14–16), the feed and tension unit 350 (FIGS. 10–13), the sealing head 400 (FIGS. 3–5), and around the track 450 (FIGS. 19–20). After the strap 202 is fed around the track 450, the free end 206 is fed back into the sealing head 400. At this point the strap 202 is in position to start a strapping cycle.

Figure 10:
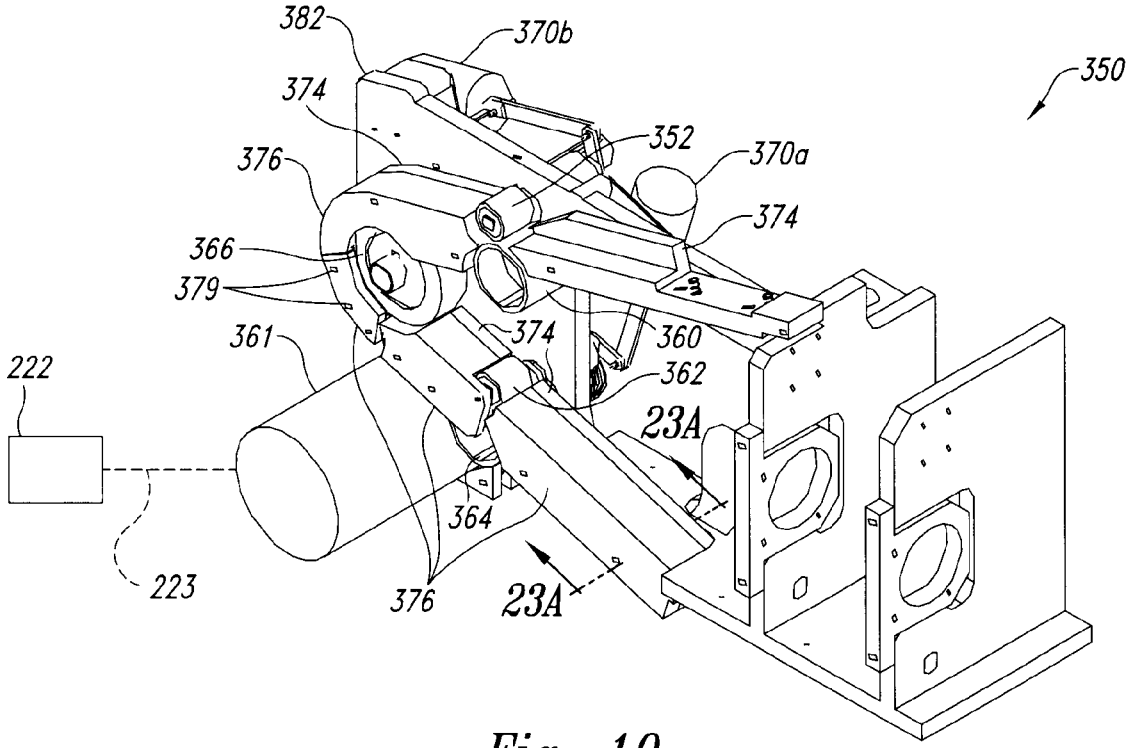
FIG. 10 is a first isometric view of a feed and tension unit in accordance with an embodiment of the invention.

Upon the start of the strapping cycle, several sealing head cams 402 in the sealing head 400 (FIGS. 3–5) begin to rotate, forcing a left-hand gripper 404 to pinch the free end 206 of the strap 202 against an anvil 406. After gripping the strap 202 in the sealing head 400, the feed and tension unit 350 (FIGS. 10–13) retracts the strap 202 from the track 450. As the strap 202 is pulled from the track 450, the strap 202 is tensioned around a bundle of objects (not shown) located in a strapping station 208 (FIG. 2) by a feed and tension motor 361 (FIG. 10). As the strap 202 becomes tight around the bundle, a primary tension pinch wheel 352 (FIG. 10) stops rotating. A proximity sensor 354 (FIG. 11) detects the lack of rotation of the primary tension pinch wheel 352 (FIG. 12) and starts a secondary tension process.

Preferably, the cams 402 operate as cycloidal cams allowing the sealing head 400 to operate smoothly at increased speeds and the cam follower pressure angles are minimized to extend cam life. As used herein, the term cycloidal cam means a cam with cycloidal displacement generated by taking a sinusoidal acceleration function that has a magnitude of zero at its beginning and end, and integrating the function to obtain the velocity and displacement of the follower.

Figure 3:
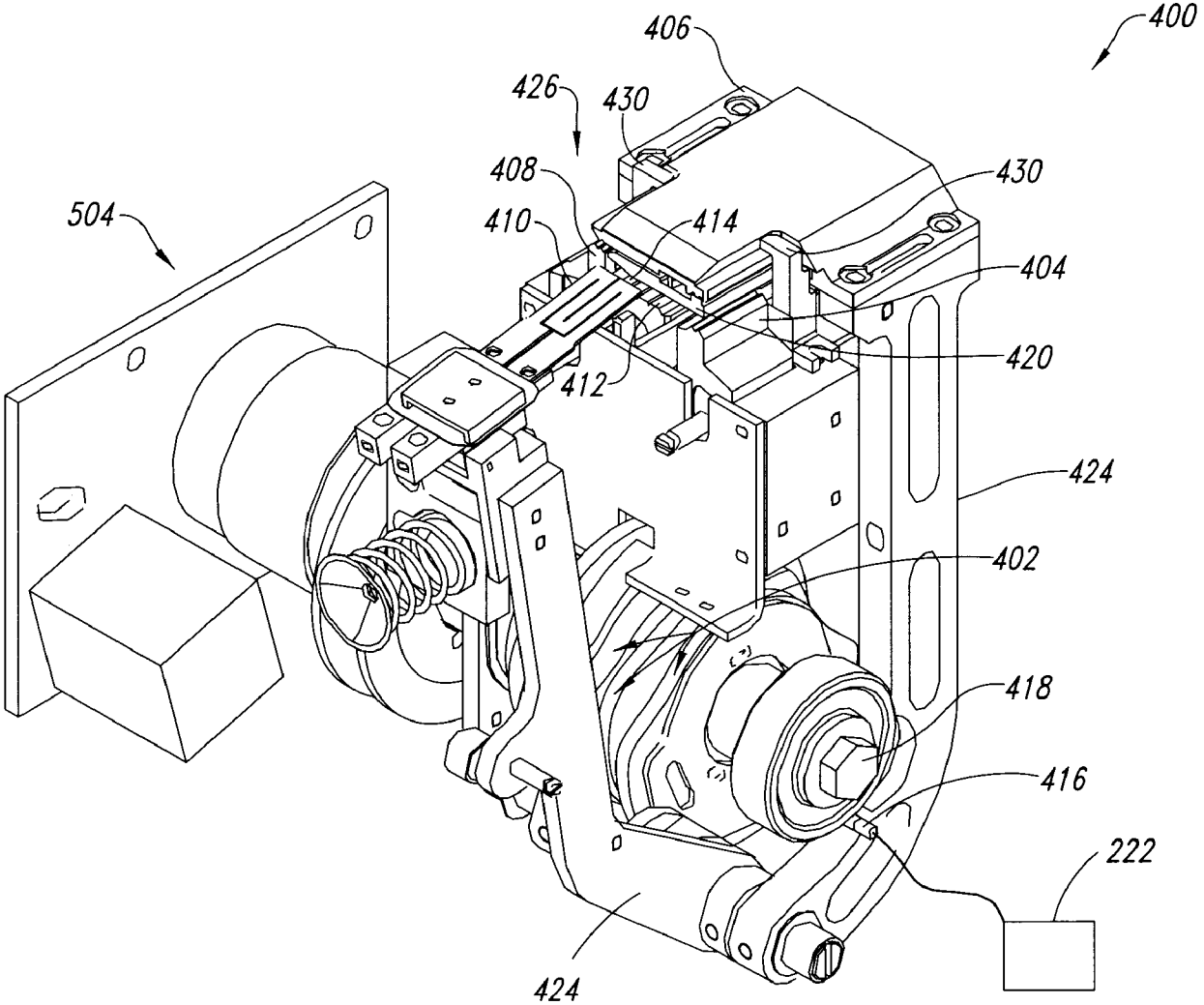
FIG. 3 is an isometric view of a sealing head in accordance with an embodiment of the invention.
Figure 6:
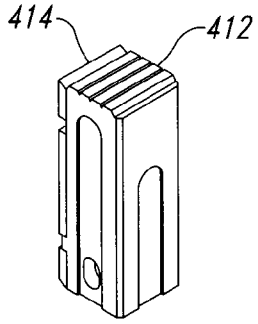
FIG. 6 is an isometric view of a press platen and a cutter of the sealing head of FIG. 3.

Secondary tension is applied until a drive wheel clutch 356 (FIGS. 7–8) slips, at a predetermined set-point, and the sealing head 400 rotates far enough to grip the strap 202 with a right-hand gripper 408. After the strap 202 is gripped by the right-hand gripper 408, the tension on the free end 206 of the strap 202 is released and the strap 202 around the bundle is cut free from the coil 204 by a cutter 414 (FIGS. 3 and 6). The two overlapping ends of the strap 202 are then heated by inserting a heater blade 410 (FIG. 3) between them and lightly pressing the straps against the blade 410 with a press platen 412 (FIG. 3). The press platen 412 then lowers slightly and the heater blade 410 is removed from between the strap ends. Next, the press platen 412 presses both ends against the anvil 406 (FIG. 3) for bonding and cooling. As the sealing head cams 402 continue to rotate, the press platen 412 lowers slightly allowing the anvil 406 to open and release the sealed strap. After the strap is released, the anvil 406 is closed and the strapping cycle is completed by feeding strap 202 through the sealing head 400, around the track 450, back into the sealing head 400 and finally actuating a feed stop switch 416 (FIG. 3).

Two modes of operation are available: manual and automatic. The manual mode applies single or multiple straps while an operator actuates a switch. The automatic mode applies a single strap or multiple straps when a switch is actuated by a moving bundle. The automatic mode is used in conveyor lines and in conjunction with other automated machinery.

As shown in FIG. 2, the frame 210 consists of a main support 212, adjustable legs 214, and cover plates 216. The frame 210 provides structural support for all of the other sub-assemblies of the strapping machine 200. In this view, the strap 202 is fed about the track 450 in a strap-feed direction 209 that is generally counter-clockwise.

The strapping machine 200 is controlled by a control system 220 that may include a programmable logic controller 222 (FIG. 3) that operates in conjunction with various input and output devices and controls the major subassemblies of the strapping machine 200. Input devices may include, for example, momentary and maintained push buttons, selector switches, toggle switches, limit switches and inductive proximity sensors. Output devices may include, for example, solid state and general purpose relays, solenoids, and indicator lights. Input devices are scanned by the controller 222, and their on/off states are updated in a controller program 224. The controller 222 executes the controller program 224 and updates the status of the output devices accordingly. Other control functions of the controller 222 are described below in further detail.

In one embodiment, the programmable controller 222 and its associated input and output devices may be powered using a 24 VDC power supply. The controller 222, power supply, relays, and fuses may be contained within a control panel (not shown). The momentary and maintained push buttons, selector switches, and toggle switches may be located on a control pendant or a control panel cover. The limit switches, inductive proximity sensors, and solenoids are typically located within the strapping machine 200 at their point of use. At least one indicator light may be mounted on the top of the track 450 and may light steadily to indicate an out-of-strap condition, and may flash to indicate a strap misfeed condition.

One commercially-available programmable controller 222 suitable for use with the strapping machine 200 is the T100MD1616+PLC manufactured by Triangle Research International Pte Ltd in Singapore. This device includes sixteen NPN-type digital outputs, four of which are NPN Darlington Power Transistor types and twelve of which are N-channel power MOSFET types. Two of the outputs are capable of generating a Pulse Width Modulated (PWM) signal with a frequency and duty cycle determined in the programming software. Also included are four input channels of 10-bit analog-to-digital converters. Two of the input channels are buffered by operational amplifiers with a x5 gain accepting analog signals of 0–1V full scale. The remaining two channels are unbuffered and accept 0–5V full scale analog signals. The unit includes a stable 5V (+/−1% accuracy) regulated DC power supply to be used as a voltage reference for the analog inputs. A single channel 8-bit digital-to-analog output utilizing a 0–20 mA current loop signal, also resides on the PLC.

The T100MD1616+PLC has communication ports, including an RS232C port for program uploads, downloads and monitoring, a two-wire RS485 network port, a 14-pin LCD display port for possible future use as a diagnostic display driver, and a port for expansion. The PLC itself is controlled by a custom CPU that has both EEPROM and RAM memory backup. The controller program 224 used to program the controller 222 may, for example, include Trilogi programming software available from Triangle Research International Pte Ltd, and may include both ladder logic and Basic type code (described more fully at tri.com.sg/index.htm).

Figure 4:
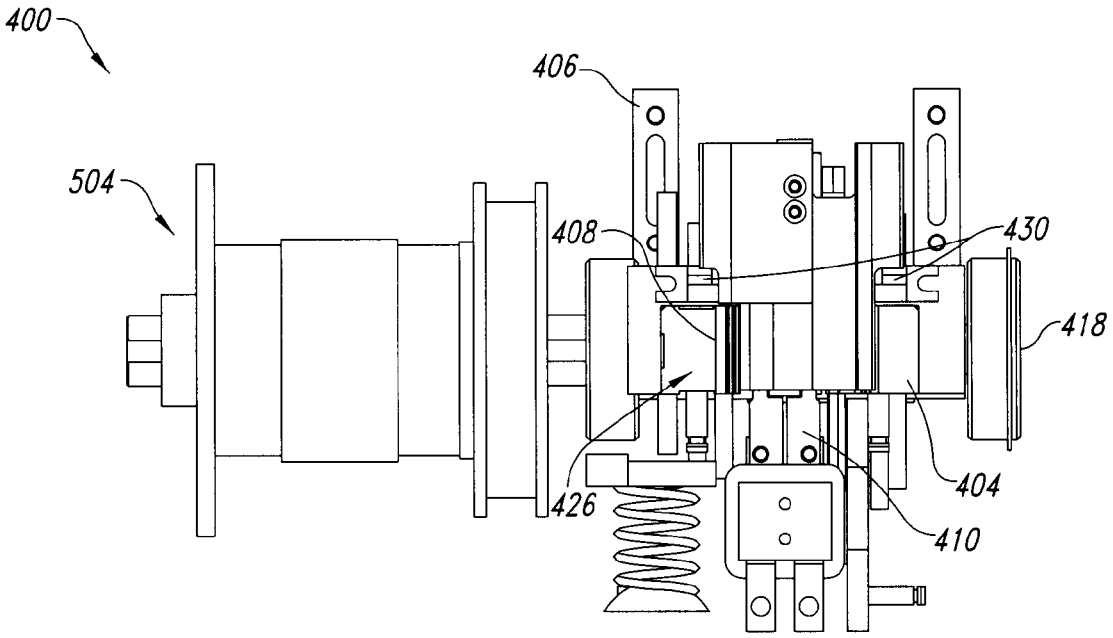
FIG. 4 is a top elevational view of the sealing head of FIG. 3.
Figure 5:
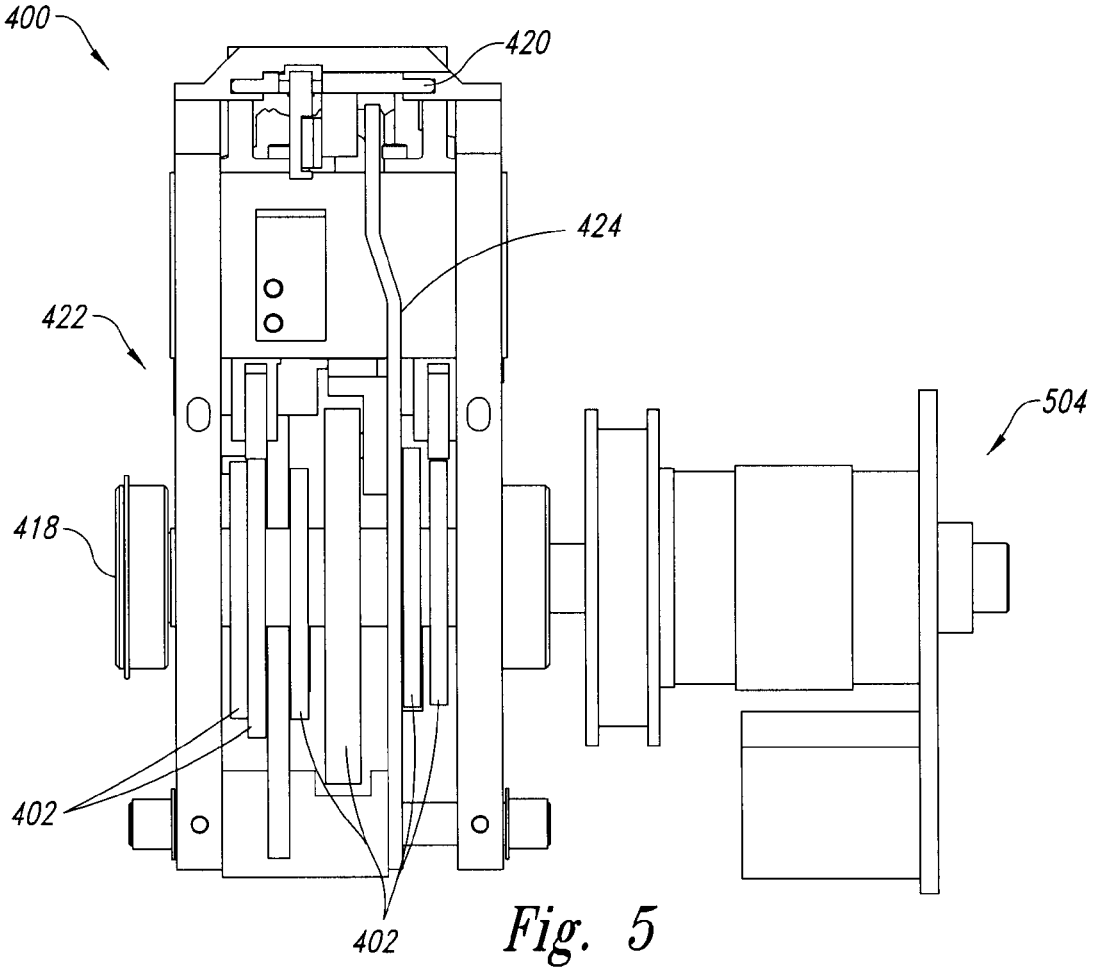
FIG. 5 is a back elevational view of the sealing head of FIG. 3.

FIG. 3 is an isometric view of the sealing head 400 of the strapping machine 200 of FIG. 2. FIGS. 4 and 5 are top elevational and back elevational views, respectively, of the sealing head 400 of FIG. 3. FIG. 6 is an isometric view of the press platen 412 and the cutter 414 of the sealing head 400 of FIG. 3. The sealing head 400 comprises a motor-driven main shaft 418 and a series of cams 402 which perform gripping, sealing and cutting functions. These cams 402 drive three sliding members 422 and three rotating arms 424 (FIG. 5). One slide member 422 is coupled to the right-hand gripper 408, another slide member 422 is coupled to the left-hand gripper 404, and the third slide member 422 is coupled to the press platen 412. The sliding members 422 perform the gripping, sealing and cutting functions, while the pivoting arms 424 move an inner slide 420, the anvil 406, and the heater blade 410 into and out of a strap path as required during a strapping cycle.

Figure 22:
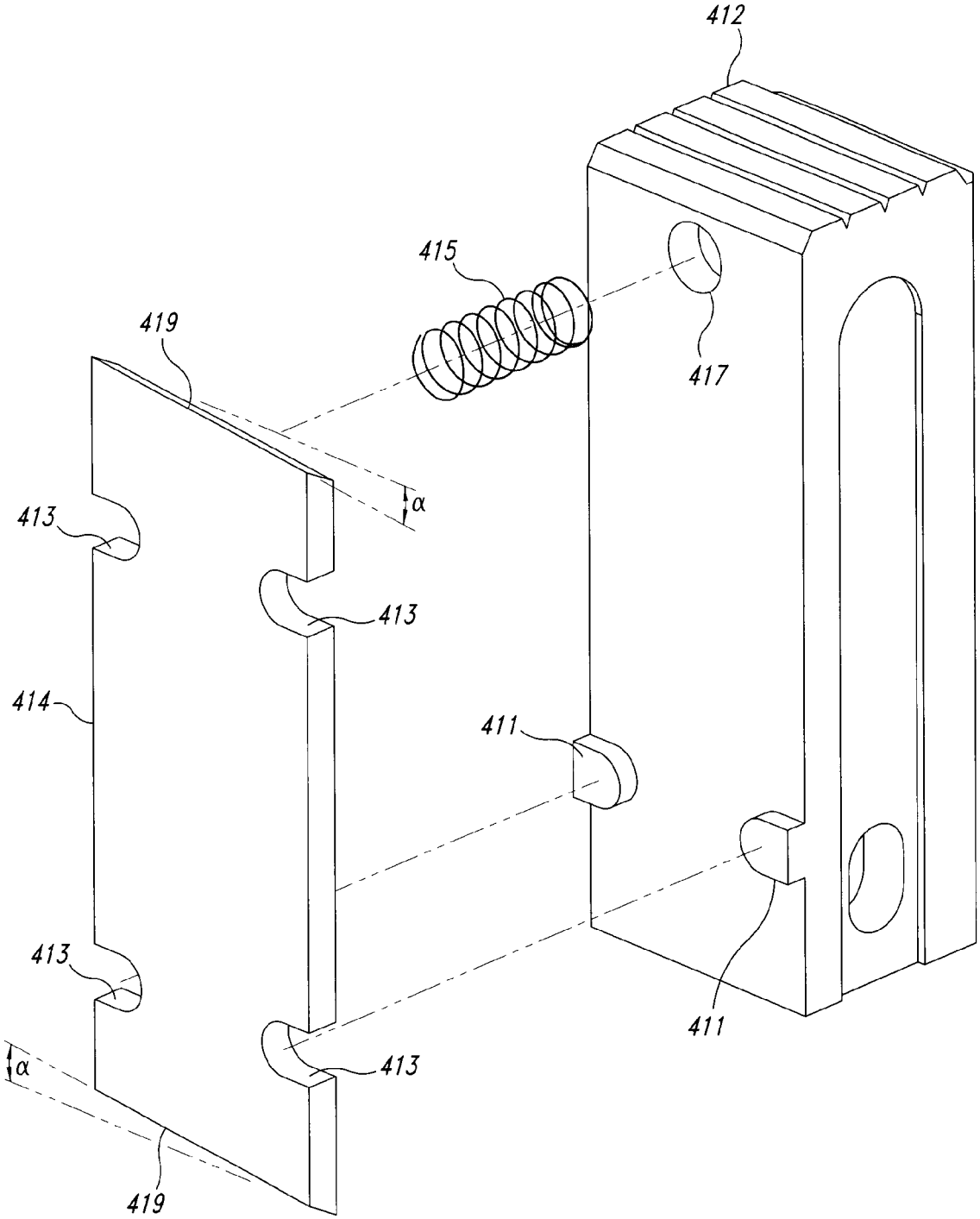
FIG. 22 is an exploded isometric view of the press platen and cutter of FIG. 6.

FIG. 22 is an exploded isometric view of the press platen 412 and cutter 414 of FIG. 6. As shown in this view, the press platen 412 includes a pair of mounting nubs 411, and the cutter 414 includes mounting recesses 413. A spring 415 is disposed between the cutter 414 and the press platen 412, one end of the spring 415 being partially disposed within a seating hole 417 disposed in the press platen 412. The cutter 414 has cutting edges 419 at both ends, allowing the cutter 414 to be reversibly positioned on the press platen 412 for added operational life. In the embodiment shown in FIG. 22, the cutting edges 419 are slanted at an angle $\alpha$. Although a wide variety of cutting edge angles $\alpha$ may be used, a cutting edge angle in the range of approximately 9 degrees or less is preferred.

During assembly, the spring 415 is compressed between the cutter 414 and the press platen 412 until the two mounting recesses 413 slideably engage two of the mounting nubs 411. One may note that the cutter 414 has a pair of mounting recesses 413 situated near each end of the cutter 414 which allows the cutter 414 to be reversibly mounted onto the press platen 412. The cutter 414 and the press platen 412 are then positioned securely between the left and right-hand grippers 404, 408 with the pressure from these parts maintaining the compression of the spring 415. The cutter 414 and press platen 412 are then engaged with the third slide member 422. This arrangement provides the necessary scissors action to sever the strap 202.

An advantage of the cutter 414 and press platen 412 assembly shown in FIGS. 6 and 22 is that the cutter 414 is removably and replaceably mounted to the press platen 412 by slideably engaging onto the press platen 412. This allows the cutter 414 to be more easily removed for replacement or maintenance than in the prior art devices. The reversibility of the cutter 414 also essentially doubles the useful life of the component.

Figure 7:
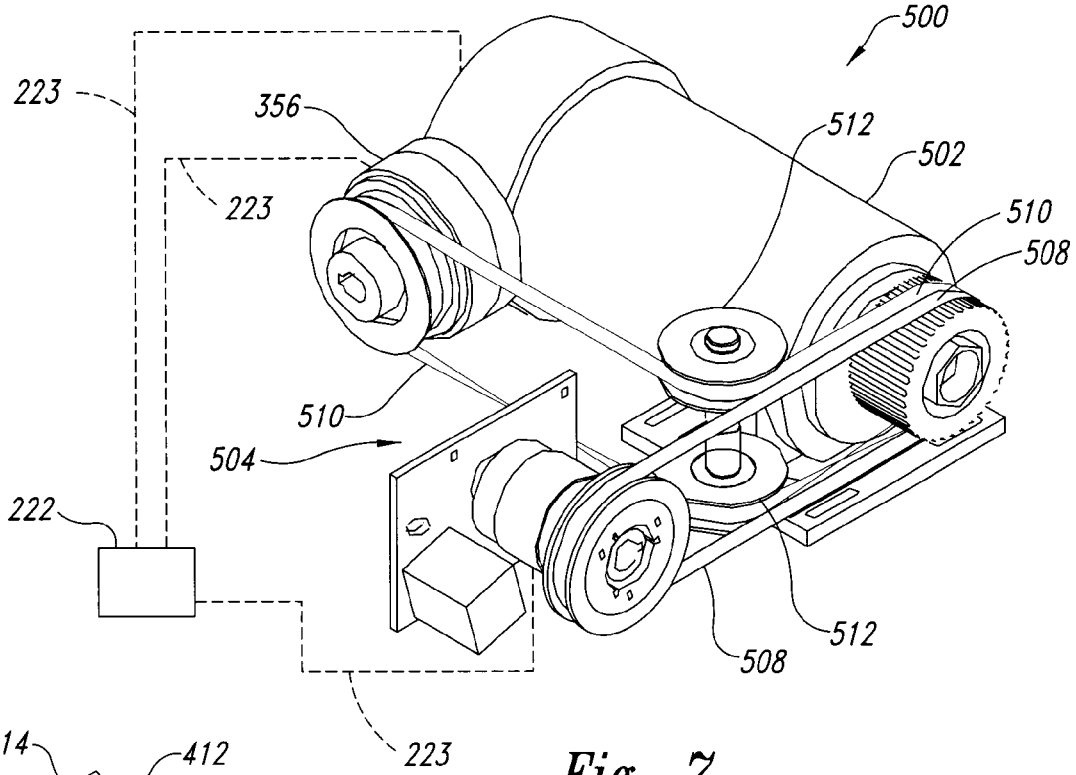
FIG. 7 is an isometric view of a main drive assembly in accordance with an embodiment of the invention.
Figure 8:
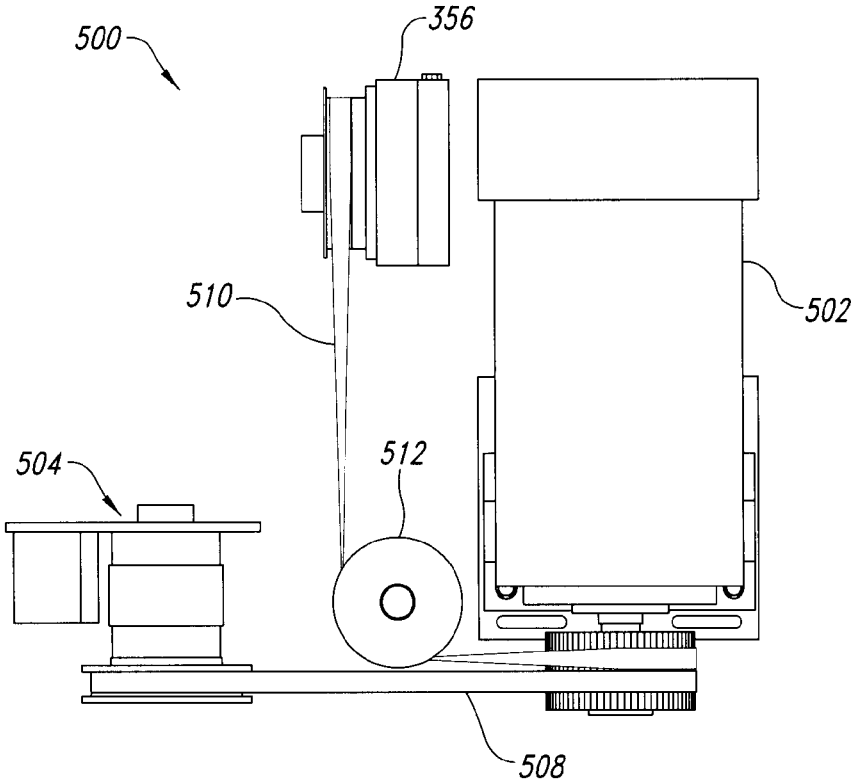
FIG. 8 is a top elevational view of the main drive assembly of FIG. 7.
Figure 9:
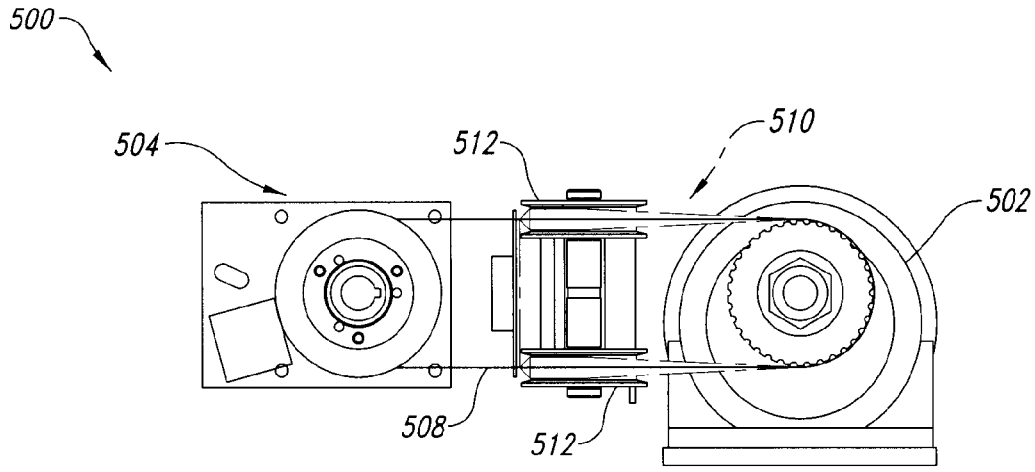
FIG. 9 is a side elevational view of the main drive the assembly of FIG. 7.

FIG. 7 is an isometric view of a main drive assembly 500 in accordance with an embodiment of the invention. FIGS. 8 and 9 are top and side elevational views, respectively, of the main drive assembly 500 of FIG. 7. The main drive assembly 500 includes a main drive motor 502 that drives a sealing head drive belt 508 and a drive wheel belt 510. The sealing head drive belt 508 and the drive wheel belt 510 are preferably "toothed" belts. The sealing head drive belt 508 is directly coupled to a spring clutch 504. The drive wheel belt 510 is turned approximately 90 degrees on a pair of drive pulleys 512 and is coupled to the drive wheel clutch 356. As shown in FIG. 7, the main drive motor 502, the spring clutch 504, and the drive wheel clutch 356 are operatively coupled to the controller 222, such as, for example, by electrically conductive leads 223.

One advantage of the main drive assembly 500 is that the drive wheel clutch 356 is driven by the drive wheel belt 510, which is turned at an approximately 90 degree angle on the drive pulleys 512. This arrangement, commonly referred to as a "mule drive," eliminates a 90-degree gearbox commonly found in drive systems of prior art strapping machines. Thus, the complexity and costs of fabrication of the main drive assembly 500 are reduced, and reliability and maintainability is improved.

In the embodiments shown in the accompanying figures, the spring clutch 504 is a wrap spring clutch and the drive wheel clutch 356 is an electromagnetic clutch. Alternately, other spring clutch 504 and drive wheel clutch 356 embodiments may be used. The spring clutch 504 stops the sealing head cams 402 at the proper degree of rotation during each stage of the cycle and stops the cams 402 in their home position at the end of each cycle. As stated above, the drive wheel clutch 356 slips at a torque that is determined by the voltage supplied to a coil located within the electromagnetic drive wheel clutch 356. The slip in the drive wheel clutch 356 determines the amount of secondary tension that is applied to the strap 202.

The main drive motor 502 drives the sealing head 400 by means of the sealing head drive belt 508 and the spring clutch 504 (FIGS. 7 and 8) which is mounted over an end of the sealing head main shaft 418 (FIG. 3). Rotation of the main shaft 418 causes the keyed cams 402 (FIGS. 3 and 5) to rotate and perform the necessary gripping, sealing and cutting functions. During a first period of rotation, the main shaft 418 rotates to the first of three stops on the spring clutch 504, causing a cutter-gripper assembly 426 to grip the strap 202 and the inner slide 420 to move out of the strap path. The main drive motor 502 then tensions the strap about the bundle, as will be described more fully below. When the strap tensioning is complete, the controller 222 pulses the spring clutch 504 allowing the cams 402 to rotate in a second period of rotation.

During the second period of rotation the right-hand gripper 404 grips the tensioned strap just ahead of the feed stop switch 416 and the tension in the strap is then released. After the tension is released, the platen 412 and the cutter 414 (FIGS. 6 and 22) rise to cut the strap 202 and press the strap against the heater blade 410. The cams 402 continue to rotate through a dwell section as the strap 202 melts on the heater blade 410. After a predetermined time for melting has passed, the press platen 412 and the cutter 414 retract slightly allowing the heater blade 410 to retract.

After the heater blade 410 retracts, the press platen 412 rises again to press the two melted ends of the strap 202 together for cooling and sealing. The sealing head main shaft 418 continues to rotate during a third period of rotation until a clutch trigger 428 disengages the spring clutch 504. The sealing head 400 maintains this position for a predetermined time until the controller 222 again energizes a spring clutch solenoid 506 (not shown) located within the spring clutch 504. The continued rotation of the cams 402 releases the press platen 412 and drops the left and right-hand grippers 404, 408 to their one positions. One of the cams 402 then pivots the anvil 406 out of the strap line past a air of strippers 430. As the anvil 406 pivots, the strippers 430 push the strap off of the anvil 406. After the strap 202 is out of the sealing head 400, the anvil 406 closes, and the cams 402 reach their home positions. At the home position the spring clutch 504 reaches the third and final stop as the feed stop switch 416 (FIG. 3) signals the controller 222 to begin another feed sequence.

Figure 11:
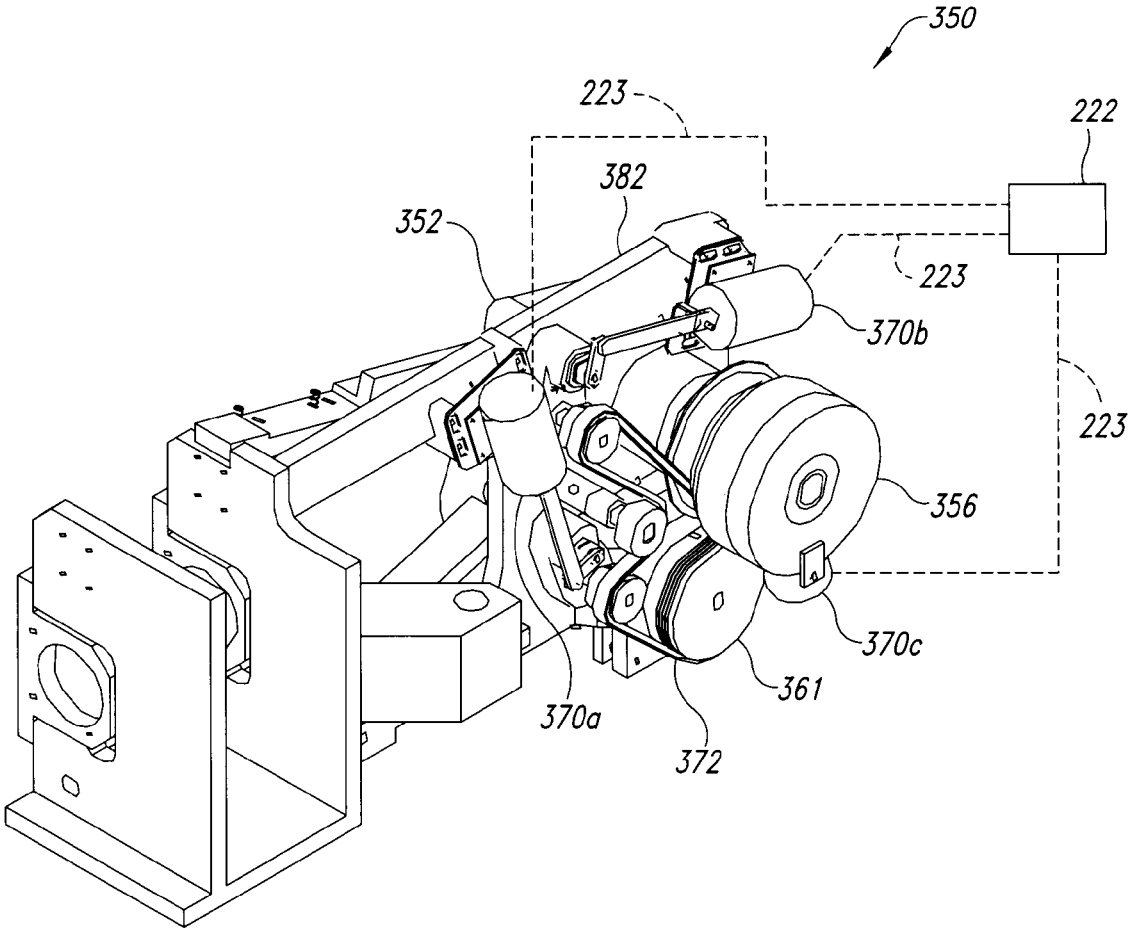
FIG. 11 is a second isometric view of the feed and tension unit of FIG. 10.
Figure 12:
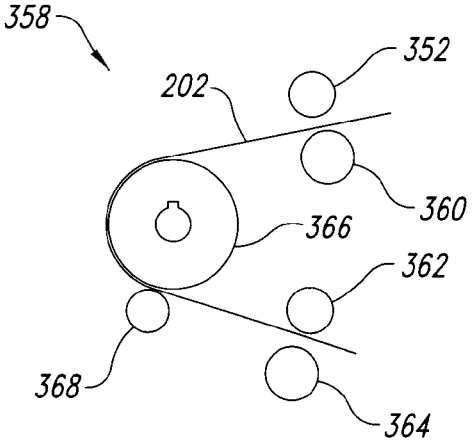
FIG. 12 is a partial front elevational view of a strap path of the feed and tension unit of FIG. 10.

FIG. 10 is a first isometric view of the feed and tension unit 350 in accordance with an embodiment of the invention. FIGS. 11 and 12 are a second isometric view and a partial front elevational view, respectively, of the feed and tension unit 350 of FIG. 10. As best seen in FIG. 12, there are three sets of wheels in the feed and tension unit 350: (1) a primary tensioning set including a primary tension drive wheel 360 and a primary tension pinch wheel 352, (2) a secondary tensioning set including a secondary tension drive wheel 362 and a secondary tension pinch wheel 364, and (3) a feeding set including a feed drive wheel 366 and a feed pinch wheel 368.

The feed and tension unit 350 pinches the strap 202 between each of the three sets of drive wheels and pinch wheels. The feed, primary tension, and secondary tension pinch wheels 366, 360, 362 are engaged against the strap 202 by a feed pinch solenoid 370*a*, a primary tension pinch solenoid 370*b*, and a secondary tension pinch solenoid 370*c*, respectively. The drive wheel clutch 356 is powered by a drive wheel belt 510 from the main drive motor 502. The primary tension and feed drive wheels 360, 366 are powered by a secondary drive belt 372 mounted on a feed and tension motor 361. The secondary tension drive wheel 362 is powered by the drive wheel clutch 356 that is driven by the drive wheel belt 510 from the main drive motor 502. As shown in FIGS. 10 and 11, the feed and tension motor 361, and the solenoids 370*a*, 370*b*, 370*c* are operatively coupled to the controller 222 by conductive leads 223.

Unlike prior art strapping machines which feed the strap around several bends in the feed and tension unit prior to reaching the track, the strapping machine 200 features a simplified strap path (FIG. 12) allowing the strap to be fed in a straighter path than previously achievable. The path begins at the supply dispenser 250 that is located on the opposite side of the strapping machine from the feed and tension unit. This position further enables the strap to travel in a less tortuous path. As shown in FIG. 12, the drive wheels 360, 366, and 362 are positioned in an approximately triangular orientation, with the strap 202 traversing an approximately "V-shaped" strap path having an included angle of in the range of approximately 20 degrees to approximately 40 degrees. Less bending of the strap reduces friction throughout the system, increasing the reliability of strap feeding. Less bending also reduces the tendency of the strap to permanently deform and cause feeding difficulties. Thus, the feed and tension unit 350 of the present invention advantageously reduces or eliminates kinks in the strap which lead to feeding difficulties. While the strapping machines of the prior art typically turned the strap through a total of 360 degrees or more prior to reaching the track, the feed and tension unit 350 greatly reduces the amount of turning of the strap. For example, in the embodiment shown in the accompanying figures, the strap is turned through between approximately 180 and approximately 220 degrees as the strap is initially fed from the dispenser 250 across the strapping machine to the sealing head 400.

Figure 23:
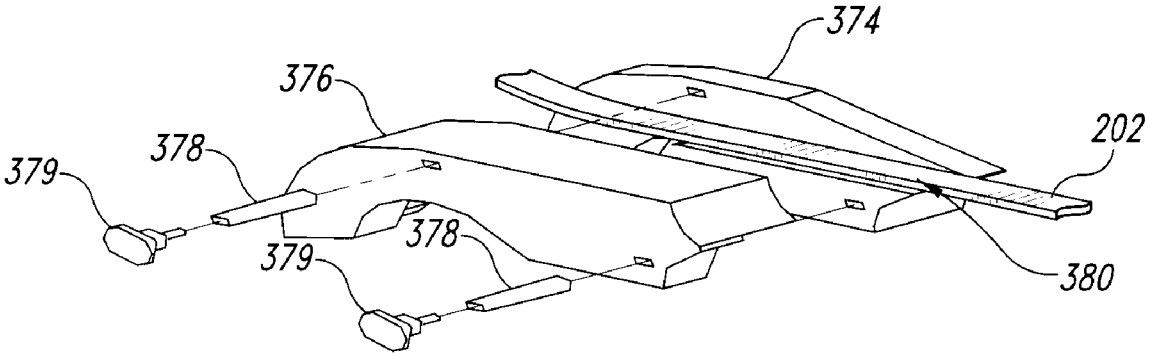
FIG. 23 is an enlarged partially-exploded isometric view of a pair of inner and outer strap guides of the feed and tension unit of FIG. 10.
Figure 23A:
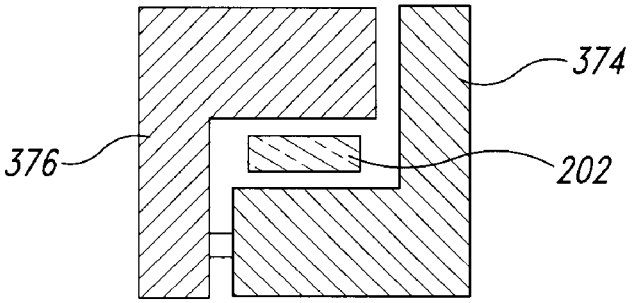
FIG. 23A is a cross-sectional view of the inner and outer guides of FIG. 23 to illustrate the guide slot created by the inner and outer guides.

As the strap 202 passes through each set of pinch wheels, a plurality of inner guides 374 and a plurality of outer guides 376 keep the strap 202 in line with the sealing head 400. FIG. 23 is an enlarged partially-exploded isometric view of a pair of inner and outer strap guides 374, 376 of the feed and tension unit 350 of FIG. 10. As best viewed in FIG. 23, each "L-shaped" inner guide 374 has a roughly L-shaped cross-section and is coupled to a matching "L-shaped" outer guide 376 to form a strap channel 380 through which the strap 202 passes. FIG. 23A is a cross-sectional view of the inner guide 374 and outer guide 376 and illustrates the guide chamber formed by the inner and outer guides to guide the strap material 202.

The inner and outer guides 374, 376 are secured in position on a plurality of guide pins 378 which project from a back plate 382 (FIG. 10) of the feed and tension unit 350 by a plurality of retaining knobs 379, although a variety of other securing devices may be used. In FIG. 10, one of the outer guides 376 is removed from the strap path adjacent to the primary tension pinch and drive wheels 352, 360 to provide a view of one of the "L-shaped" inner guides 374.

During a feeding sequence, the strap 202 is pinched between the feed drive and pinch wheels 366, 368. In one embodiment, a feed force applied by the feed drive and pinch wheels 366, 368 is regulated by a pulse width modulated solenoid 370*a* in two stages: a first stage that provides a full feed force and a second stage that provides a reduced feed force by altering the pulse width modulation of the feed pinch solenoid 370*a*. Because the pinch force exerted by a solenoid 370*a* on the strap 202 varies with supplied voltage, supplying a pulse width modulated voltage signal to the solenoid 370*a* provides the ability to vary the force exerted by the solenoid 370*a*. As the force exerted by the solenoid 370*a* is decreased, the strap 202 is permitted to slip on the feed drive wheel 366 more easily with a decreased amount of feed drive force. Commercially-available solenoids suitable for this purpose include those solenoids available from Ledex®) Actuation Products of Vandalia, Ohio.

It should be noted that the frequency of the pulses which are fed to the solenoid affects the operation and performance of the solenoid. Generally, as the frequency of the pulses is increased, the adjustability of the pinch force exerted by the solenoid is improved. For example, using the above-referenced solenoids available from Ledex® Actuation Products, a pulse frequency of 8000 Hz has been successfully used.

The feed drive and pinch wheels 366, 368 feed the strap through the sealing head 400, around the track 450, and back into the sealing head 400. When the free end 206 of the strap 202 reaches the sealing head 400, the arrival of the free end 206 is detected by feed stop switch 416, which transmits a feed stop signal to the controller 222. The controller 222 then sends a feed pinch signal to the feed pinch wheel 368 to disengage the feed pinch wheel 368 from the strap 202, and the feeding sequence is complete.

During a primary tensioning sequence, the strap 202 is pinched between the primary tension drive wheel 360 and the primary tension pinch wheel 352. In a first primary tension stage, the primary tension solenoid 370*b* engages the primary tension pinch wheel 352 against the primary tension drive wheel 360 with full pinch force to ensure that the primary tensioning solenoid engages and the strap 202 is pulled free of the track 450. the pinch force is then reduced during a second primary tension stage by altering the pulse width modulation of the primary tension solenoid 370*b*. As the strap 202 is pulled tightly around the bundle during the primary tensioning sequence, the primary tension pinch wheel 352 stops rotating due to the slippage of the strap on the primary tensioning drive wheel 360.

Using pulse width modulation to control the pinch forces exerted by the solenoids 370*a*, 370*b* during feeding and primary tensioning of the strap advantageously allows the operator a larger range of adjustment than is possible with a mechanical, single force adjustment system of the prior art. The two-stage force operation provides improved controllability of the strap 202 movement, including allowing the strap 202 to be quickly accelerated and to be easily stopped as required by the operator.

Figure 13:
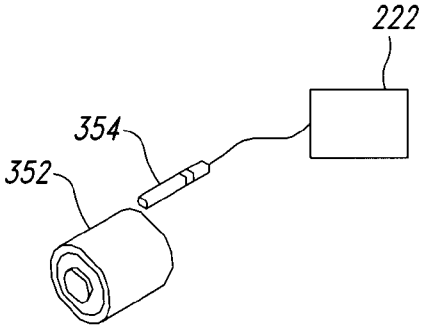
FIG. 13 is a partial isometric view of a primary pinch wheel and a proximity switch of the feed and tension unit of FIG. 10.

FIG. 13 is an isometric view of the primary tension pinch wheel 352 and the proximity sensor 354 of the feed and tension unit 350 of FIG. 10. The proximity sensor 354 is operatively coupled to the controller 222. The proximity sensor 354 monitors the primary tension pinch wheel 352 during primary tensioning, such as by monitoring the passing of notches in the wheel 352, to detect the stall of the primary tension pinch wheel 352. The proximity sensor 354 transmits signals to the controller 222. As the signals from the proximity sensor 354 indicate that the primary tension pinch wheel 352 is not turning due to the slippage of the strap 202 on the primary tension drive wheel 360, the controller 222 starts a secondary tensioning sequence.

The secondary tensioning sequence begins by pinching the strap between the secondary tension pinch wheel 364 and the secondary tension drive wheel 362. Then, the secondary tension drive wheel 362 is driven by the drive wheel clutch 356 until the drive wheel clutch 356 starts to slip. After the strap 202 is tensioned to the point that the drive wheel clutch 356 slips, the controller 222 permits a predetermined amount of time to pass to allow the strap to be cut and sealed as described above. The feeding sequence may then be repeated.

An advantage of the strapping machine 200 is that the pinch wheels 352, 364, 368 are actuated by the solenoids 370*a*, 370*b*, 370*c*. Using a two-stage pulse width modulated (PWM) signal, the solenoids are adjustably controllable by the user during strapping machine 200 operation. During the first stage, the solenoid is given a PWM signal at a constant duty cycle. For the second stage, the solenoid is controlled using a PWM signal with a duty cycle that is user-adjustable via, for example, a potentiometer. Since the average voltage seen by the solenoid is determined by the duty cycle, varying the duty cycle will vary the amount of force the solenoid pulls. Thus, the pinch wheels 352, 364, 368 may be adjustably controlled during operation of the strapping machine 200, eliminating the labor-intensive process of mechanical re-adjustment of the pinch wheels 352, 364, 368 and the associated downtime of the strapping machine.

Figure 14:
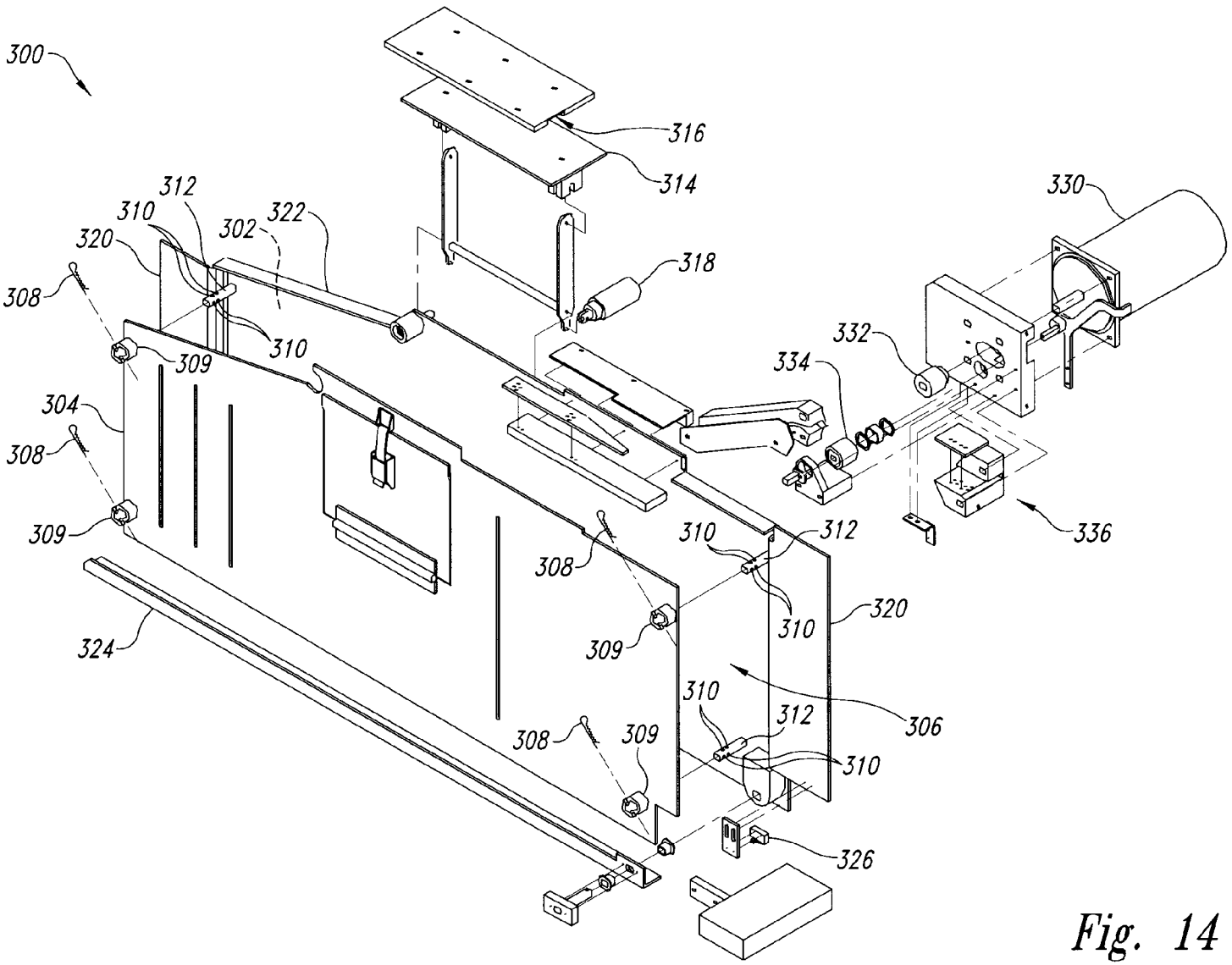
FIG. 14 is an exploded isometric view of an accumulator in accordance with an embodiment of the invention.
Figure 15:
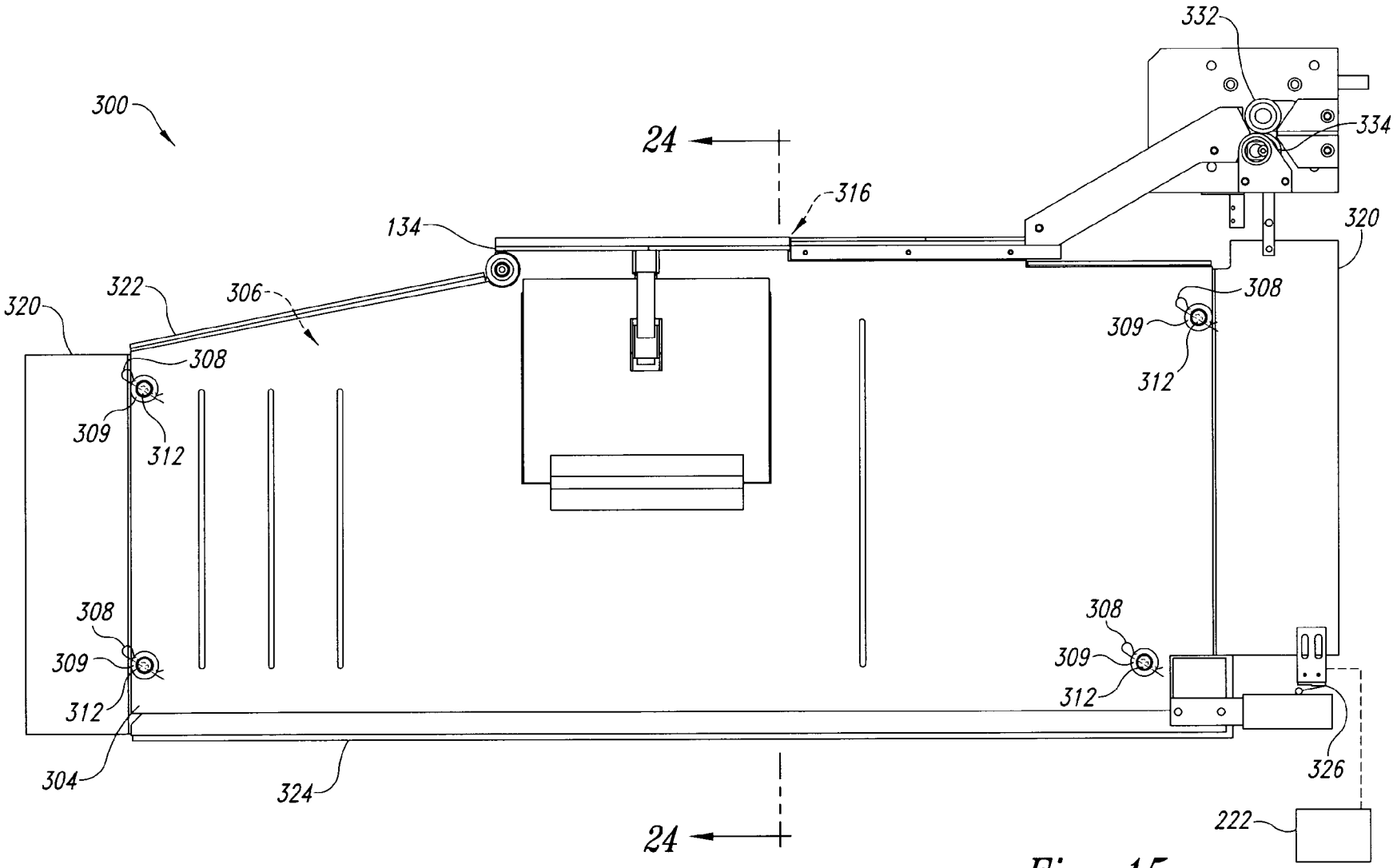
FIG. 15 is a front elevational view of the accumulator of FIG. 14.
Figure 16:
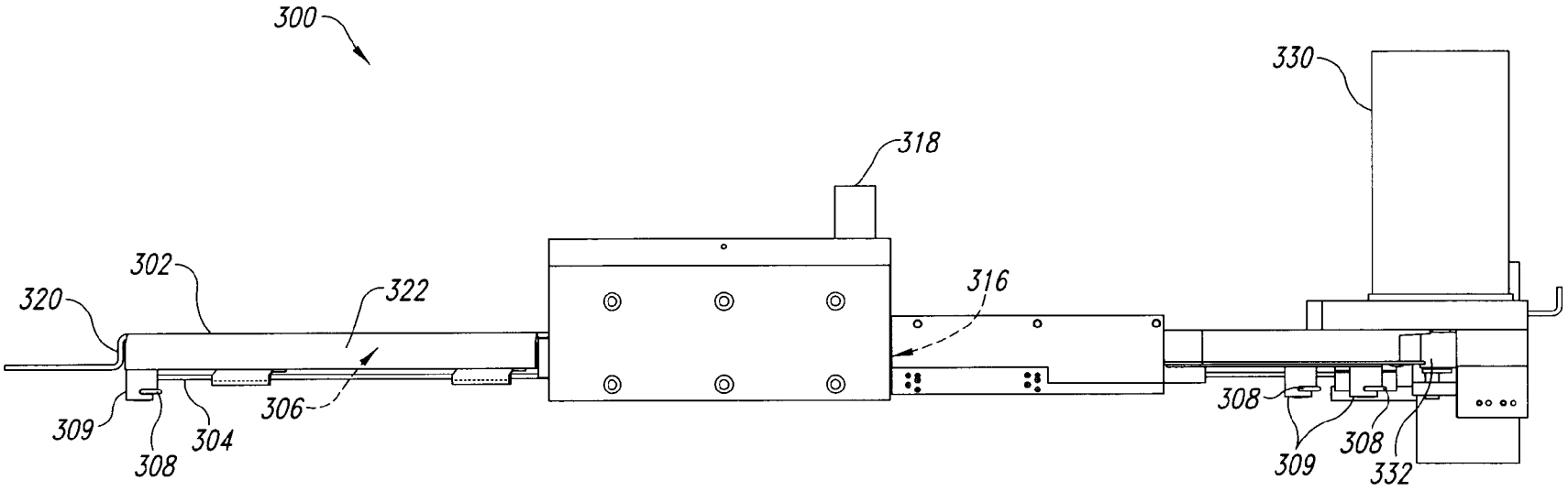
FIG. 16 is a top elevational view of the accumulator of FIG. 14.
Figure 24:
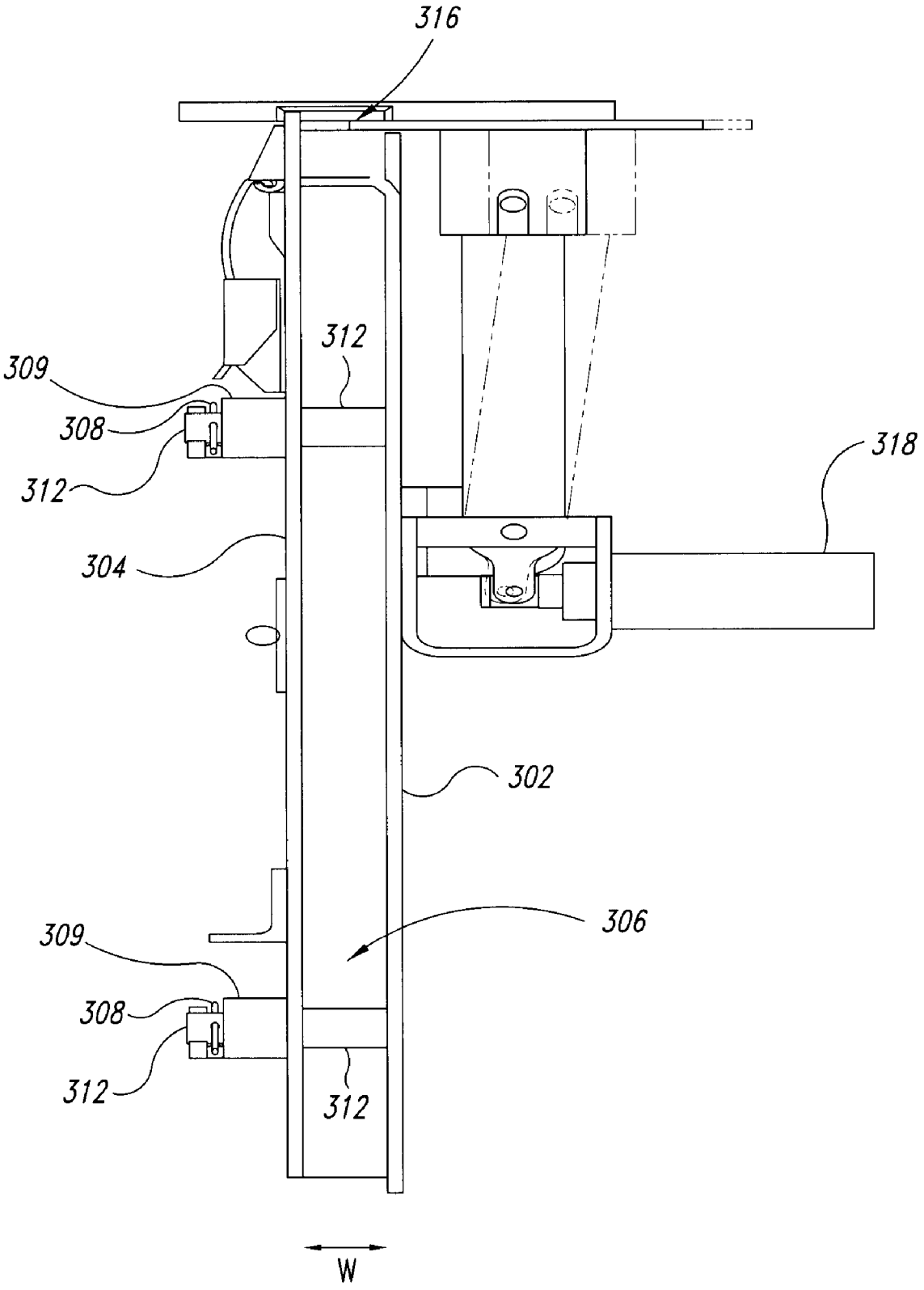
FIG. 24 is a cross-sectional view of the accumulator of FIG. 15 taken along line 24—24.

FIG. 14 is an exploded isometric view of an accumulator 300 in accordance with an embodiment of the invention. FIGS. 15 and 16 are front and top elevational views, respectively, of the accumulator 300 of FIG. 14. FIG. 24 is a cross-sectional view of the accumulator 300 of FIG. 15 taken along line 24—24. The accumulator 300 includes a first and second sidewalls 302, 304 that substantially enclose a chamber 306 that stores strap for rapid feeding, as well as for temporarily storing of the strap 202 that is drawn back in the tensioning process. The second sidewall 304 is incrementally adjustable by placing retaining pins 308 in a series of holes 310 located in shafts 312 that protrude from the first sidewall 302 to accommodate different sizes of strap 202. Pin holders 309 are attached to the second sidewall 304 which engage the retaining pins 308 and fix the position of the second sidewall 304 on the shafts 312.

The chamber 306 is substantially enclosed by the first sidewall 302 and the adjustable second sidewall 304. A pair of endwalls 320 extend vertically between the first and second sidewalls 302, 304. A top wall 322 extends horizontally along between the first and second sidewalls 302, 304, the top wall 322 having the top entrance 316 where strap 202 is fed into and pulled out of the accumulator unit 300. An "L" shaped wand 324 extends between the first and second sidewalls 302, 304 along the bottom of the chamber 306. The wand 324 is pivotally attached to the first sidewall 302.

In operation, an accumulator motor 330 (FIG. 14) drives an accumulator rive wheel 332 to feed the strap 202 between the accumulator drive wheel 332 and an accumulator pinch wheel 334. An accumulator feed switch 336 (FIG. 14) is positioned proximate the accumulator drive and pinch wheels 332, 334 to detect the presence of the strap 202 and to transmit a control signal to the accumulator motor 330. As the chamber 306 fills with strap 202, the wand 324 is pushed downwardly by the weight of the strap 202, pivoting the wand 324 into contact with an indicator switch 326 (FIG. 15). The indicator switch 326 then transmits a signal to the controller 222 to shut off the accumulator motor 330, as described more fully below.

Alternately, during an automatic feeding mode, a strap diverter 314 covers a top entrance 316 of the chamber 306. When strap 202 is fed into the strapping machine 200 by the accumulator motor 330, a diverter solenoid 318 (FIG. 14) pulls the strap diverter 314 over the top entrance 316 of the chamber 306, diverting the strap 202 directly into the feed and tension unit 350 and around the track 450.

As best seen in FIG. 24, the accumulator 300 advantageously allows the width w of the chamber 306 and the top entrance 316 to be adjusted easily and quickly to accommodate varying widths of strap 202. Unlike prior art apparatus that have accumulator sidewalls that are solidly affixed to form a single chamber size, the accumulator 300 of the present invention includes shafts 312 having a plurality of holes 310 placed at increments to match various commonly used strap sizes. Thus, the position of the second sidewall 304 with respect to the first sidewall 302 may be quickly and easily varied by removal of the retaining pins 308, repositioning the second sidewall 304 at the desired location, and replacement of the retaining pins 308 within the desired holes 310. The pin holders 309 then engage against the retaining pins 308 and fix the position of the second sidewall 304 on the shafts 312. This mounting configuration allows the adjustment of the accumulator without having any additional parts, such as spacers between the first and second sidewalls 302, 304.

Figure 17:
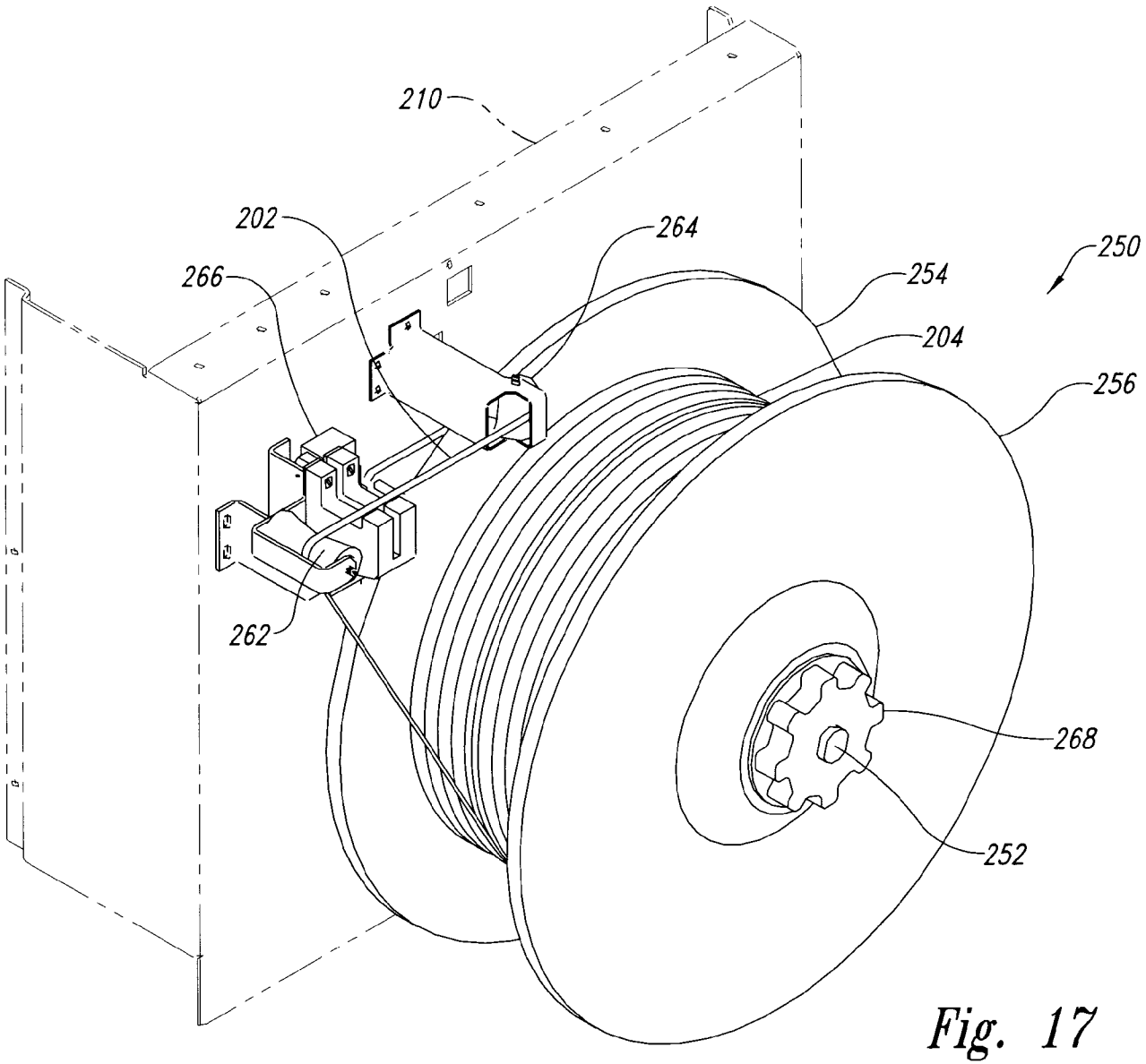
FIG. 17 is an isometric view of a dispenser in accordance with an embodiment of the invention.

FIG. 17 is an isometric view of a dispenser 250 in accordance with an embodiment of the invention. FIG. 18 is a top elevational view of the dispenser 250 of FIG. 17. The dispenser 250 includes a mounting shaft 252 extending outwardly from the frame 210 between an inner hub 254 and an outer hub 256. A spring brake 258 is operatively coupled to the mounting shaft 252 and to the frame 210. When actuated, the brake 258 allows the rotation of the mounting shaft 252. A mandrel 260 is rotatably mounted on the mounting shaft 252 and supports the inner hub 254 and the outer hub 256. Strap 202 is routed from the strap coil 204 around a first pulley 262 and a second pulley 264 and over a strap exhaust switch 266.

As strap 202 is required in the accumulator 300, the accumulator motor 330 is energized and the dispenser brake 258 released, allowing the strap coil 204 to spin freely and strap 202 to feed into the chamber 306. In this embodiment, the brake 258 releases the strap coil 204 to spin only when power is supplied to the brake 258. When the strap coil 204 is depleted, the strap exhaust switch 266 is no longer actuated which stops the strapping machine 200 until the strap coil 204 is replenished. A braking circuit is used to prevent the accumulator motor 330 from drawing the free end 206 of the strap into the accumulator 300. The remaining loose tail of strap can then be pulled out of the accumulator 300 before a new strap coil is installed. The empty strap coil 204 is replaced by removing an outer hub securing nut 268 and the outer hub 256, and then removing the strap coil core (not shown) from the mandrel 260. Next, a fresh strap coil 204 is placed on the mandrel 260 with the strap 202 wound in a clockwise direction. Finally, the outer hub 256 and the outer hub securing nut 268 are replaced and the nut tightened securely.

To begin feeding the strap 202, the free end 206 is removed from the strap coil 204, threaded around the first pulley 262, through the strap exhaust switch 266, around the second pulley 264 and between the accumulator drive wheel 332 and the accumulator pinch wheel 334. As the strap 202 is placed between the accumulator wheels 332, 334, the accumulator feed switch 336 is actuated causing the accumulator feed solenoid to actuate, thus feeding the strap over the accumulator and into the track.

When enough force is applied to the wand 324 by the weight of the strap 202 accumulating in the chamber 306, the wand 324 moves downwardly to actuate the indicator switch 326, indicating that the accumulator unit 300 is full. In response to this signal, the controller 222 de-energizes the accumulator motor 328 and the dispenser brake 330 to halt the accumulator filling sequence. A time delay occurs between when the dispenser brake 330 is de-energized and when the accumulator motor 328 is de-energized to take up any slack in the strap coil 204.

Figure 21:
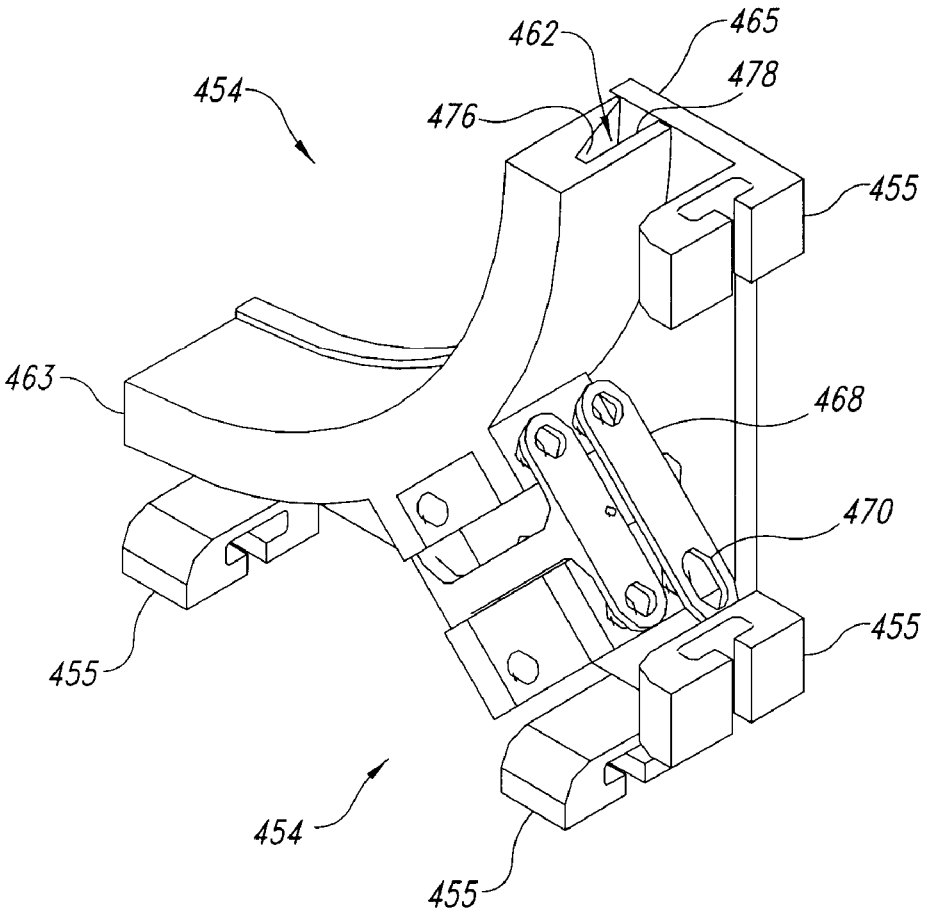
FIG. 21 is an isometric view of a corner section of the track of FIG. 19.
Figure 25:
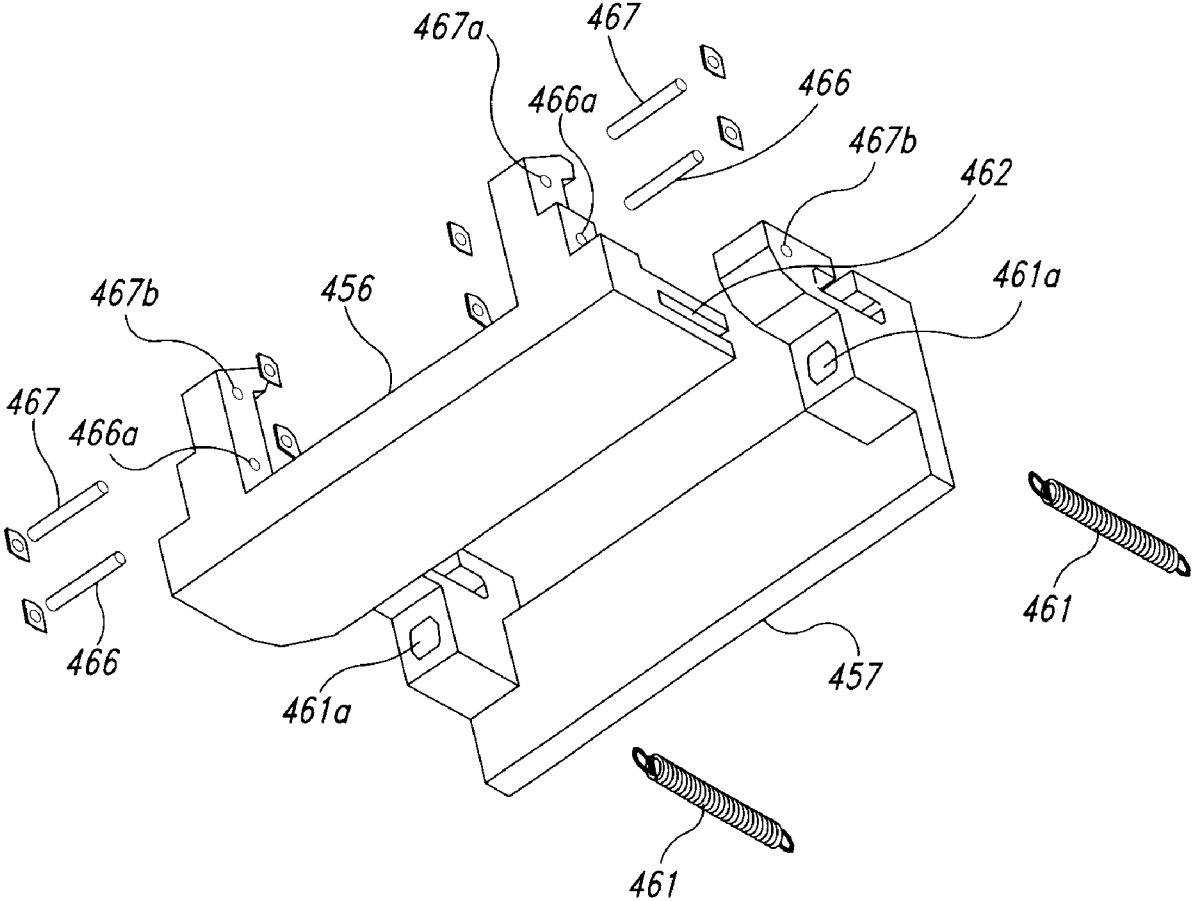
FIG. 25 is a partially exploded isometric view of a straight section of the track of FIG. 19.

FIG. 19 is an isometric view of a track 450 in accordance with an embodiment of the invention. FIG. 20 is a partial sectional view of a straight section 452 of the track 450 of FIG. 19 taken along line 20-20. FIG. 21 is an isometric view of a corner section 454 of the track 450 of FIG. 19. FIG. 25 is a partially exploded isometric view of a straight section 452 of the track 450 of FIG. 19. During feeding, after the strap 202 exits from the sealing head 400, it is pushed completely around the track 450 and then back into the sealing head 400. The track 450 directs the strap 202 around the strapping station 208.

The track 450 includes a plurality of straight sections 452 and a plurality of corner sections 454. As shown in FIGS. 19 and 20, each straight section 454 includes a guide support 455 at each end of the straight section 454. A straight slotted cover 456 and a straight backplate 457 are coupled to the straight supports 455 to form a portion of a guide passage 462 that retains the strap 202 during feeding. Each straight slotted cover 456 includes a straight inner surface 472 on the inner circumference of the guide passage 462, and a straight outer surface 474 on the outer circumference of the guide passage 462.

As best seen in FIGS. 20 and 21, the straight supports 455 and the corner supports 454 are keyed to fit on a raised "T" section 459 of an outer arch 458. The outer arch 458 forms a frame for the other components of the track 450. As the strap 200 is tensioned around the bundle, the straight and corner slotted covers 456, 463 open, allowing the strap 202 to pull clear of the guide passage 462. FIG. 20 illustrates the open position of the slotted cover 456 in phantom to assist in a more complete understanding of the invention. As the strap 202 clears the guide passage 462, each of the straight and corner slotted covers 456, 463 is closed by the springs 461 and becomes ready for the strap 202 to be fed again. The V-shape of the guide passage 462 in the corner section 454 helps assure that the strap removal begins in the corner sections 454 rather than in the straight sections 452 of the track 450. When the strap 202 (see FIG. 20) is removed from the track 450, the V-shape of the guide passage 462 in the corner section 454 causes the track cover 463 to begin opening in the corner section 454. As the strap 202 begins to separate from the track 450 in the corner sections 454, the V-shaped guide passage 462 imparts a slight twist to the strap to start opening the straight slotted 456 (see FIG. 20) in the straight sections 452 of the track 450.

As shown in FIG. 21, each corner section 454 includes a corner slotted cover 463 and a corner backplate 465 coupled to a plurality of guide supports 455. The corner slotted cover 463 and corner backplate 465 form a portion of the guide passage 462 therebetween. Each corner slotted cover 453 includes a corner inner surface 476 on the inner circumference of the guide passage 462, and a corner outer surface 478 on the outer circumference of the guide passage 462. In this embodiment, the corner slotted cover 463 and the corner backplate 465 are coupled to the guide supports 455 using a four-bar linkage assembly 469 that permits the corner slotted cover 463 to pivotably open to release the strap 202 from the guide passage 462. Although alternate embodiments for pivotably mounting the corner slotted covers 463 may be conceived, in the embodiment shown in FIG. 21, the inner bars 468 (one shown) of the four-bar linkage assembly 469 have an enlarged opening 470 to permit the corner slotted cover 463 to pivotably open about an axis of rotation that is oriented approximately 45 degrees from the horizontal.

As best shown in FIG. 25, the straight slotted cover 456 and the straight backplate 457 are spring-loaded by a plurality of springs 461. The straight slotted covers 456 and the straight backplates 457 are hingeably engaged on pivot pins 467 that are approximately parallel to the path of the strap 202 in the guide passage 462. The pivot pins 467 are inserted through corresponding apertures 467*a* and 467*b* in the straight slotted cover 456 and straight backplate 457, respectively, and rotate about an axis defined by the longitudinal axis of the pivot pins 467. The pivot pins 467 are retained in position by snap-on retainers or any other convenient retainer element.

The springs 461 are inserted through a corresponding aperture 461*a* in the straight backplate 457 and are coupled to the straight slotted cover 456 by a spring retaining pin 466. In an exemplary embodiment, the spring retaining pins 466 are identical to the pivot pins 467 and are retained within corresponding apertures 466*a* in the straight slotted cover 456 by the snap-on retainers. The springs 461 are thus coupled on a proximal end to the straight slotted cover 456 by the spring retaining pins 466 and are retained within the aperture 461*a* by an enlarged distal end, sometimes referred to as a circle cotter. This arrangement allows the straight slotted cover 456 to pivot open and release the strap 200 (see FIG. 20) and automatically close due to the spring force exerted on the straight slotted cover by the springs 461. Although various sizes of straight slotted covers 456 may be employed, in the embodiment shown in FIGS. 20 and 25, the guide passage 462 is sized to receive strap sizes varying from approximately 5 mm to approximately 15 mm.

One advantage of the track 450 of the present invention is the modular construction of the straight and corner sections 452, 454 which allows the track 450 to be incrementally extended in length and height. Because the straight and corner sections 452, 454 are keyed to fit a raised section 459 of the outer arch 458, these components form an easily assembled slide-together arch system, enabling the size of the track 450 to be easily modified for various combinations of length and height. Thus, the size of the strapping station 208 may be quickly and efficiently modified for a variety of bundle sizes.

Another advantage of the track 450 is that by pivoting the straight slotted covers 456 parallel to the strap path, and by pivoting the corner slotted covers 463 on the four-bar linkage assemblies 469, each individual straight and corner section 452, 454 may open using only the forces exerted by the strap 202 as it is tightened during tensioning. During the tension cycle, the strap 202 is drawn against the straight inner surfaces 472 and the corner inner surfaces 476, forcing the straight slotted covers 456 and corner slotted covers 463 to pivotably open in the manner described above. Thus, the track 450 does not require complex hydraulic or pneumatic actuation systems to open the track to release the strap during tensioning. This reduces costs and simplifies maintenance of the track and strapping machine.

A further advantage of the track 450 is that, in the embodiment shown in FIGS. 19 through 22, the forces exerted by the strap on the straight slotted covers 456 and corner slotted covers 463 during the feed cycle assist in keeping the track closed during feeding. During the feed cycle, the strap 202 pushes outwardly on the straight outer surfaces 474 and the corner outer surfaces 478 to create a moment (i.e., a force vector) that forces the straight slotted covers 456 and the corner slotted covers 463 toward the closed position. This aspect of the invention reduces misfeeds of the strap, and eliminates the need for complex hydraulic or pneumatic actuation systems to close the track and keep it closed during the feed cycle.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other methods and apparatus for strapping bundles of objects, and not just to the methods and apparatus for strapping bundles of objects described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. In an apparatus for bundling one or more objects with a strap material, a track assembly for releasably receiving and guiding the strap material, comprising:

a plurality of track sections, each track section having a backplate attached to at least one support member, and a slotted cover pivotably attached to the at least one support member at a pivot point, the slotted cover being positioned proximate the backplate and moveable between an open position spaced apart from the backplate and a closed position proximate the backplate by rotation about the pivot point, and a biasing member engaged with the slotted cover that exerts a biasing force on the slotted cover to urge the slotted cover toward the closed position, the track sections being positioned adjacent each other such that the slots form a guide passage sized to receive the strapping material, wherein the biasing force is small enough that a tensioning force in the strap material may overcome the biasing force to rotate the slotted cover about the pivot point to the open position to allow the strap material to escape from the guide passage.

2. The track assembly of claim 1 wherein the plurality of track sections comprise a plurality of straight sections and a plurality of corner sections.

3. The track assembly of claim 1 further comprising at least one outer support, wherein the at least one support member is slideably engaged on a raised portion of the outer support.

4. The track assembly of claim 1 wherein the slotted cover is pivotably attached to the at least one support member using a pivot pin, the pivot pin having a lengthwise axis that is approximately parallel to the guide passage.

5. The track assembly of claim 1 wherein the slotted cover includes a slot having an inner surface and an outer surface, the strap material exerting the tensioning force on the inner surface during a tension cycle and exerting a closing force on the outer surface during a feed cycle.

6. The apparatus of claim 1 wherein the plurality of track sections comprise corner track sections wherein at least one of the corner track sections has an inner guide surface and an outer guide surface with the inner guide surface being tapered proximate the backplate.

7. In an apparatus for bundling one or more objects with a strap material, a track for receiving and guiding the strap material, the track coupled to a track frame and comprising:

a support member attached to the track frame to retain the track in alignment;

a cover pivotably attached to the support member and including a slot sized to receive and guide the strap material about the track, the cover pivoting on an axis of rotation substantially parallel to a direction of movement of the strap material through the slot; and a biasing member engaged with the cover to exert a biasing force on the cover and thereby urge the cover toward a closed position, the biasing force being sufficiently small that a tensioning force in the strap material may overcome the biasing force to pivot the cover on the axis of rotation to an open position and thereby allow the strap material to escape from the slot.

8. The track of claim 7 wherein the track comprises a plurality of track sections, each having a support member and a cover, each track section being coupled to the track frame and maintained in alignment by the respective support member such that the slots in the cover of each track section are maintained in alignment to guide the strap material about the track.

9. The track of claim 8 wherein the plurality of track sections comprise a plurality of straight sections and a plurality of corner sections.

10. The track of claim 9 wherein the cover of at least one straight track section is pivotably attached to the support member using a pivot pin, the pivot pin having a lengthwise axis that is approximately parallel to the direction of movement of the strap material through the slot to thereby permit the cover to pivot on the axis of rotation substantially parallel to the direction of movement of the strap material through the slot.

11. The apparatus of claim 1 wherein the plurality of track sections comprise corner track sections wherein at least one of the corner track sections has an inner guide surface and an outer guide surface with the inner guide surface being tapered proximate the backplate.

12. The track assembly of claim 7 wherein the cover of at least one corner track section is pivotably attached to the support member using a four-bar linkage.

13. The track of claim 7 wherein the slot has an inner surface and an outer surface, the strap material exerting the tensioning force on the inner surface during a tension cycle and exerting a closing force on the outer surface during a feed cycle.

* * * * *

UNITED STATES PATENT AND TRADEMARK OFFICE

CERTIFICATE OF CORRECTION

PATENT NO. : 6,415,712 B1
DATED : July 9, 2002
INVENTOR(S) : Gary Helland et al.

It is certified that error appears in the above-identified patent and that said Letters Patent is hereby corrected as shown below:

Title page, Item [54] and Column 1, lines 1-3,
"TRACK MECHANSIM FOR GUIDING FLEXIBLE STRAPS AROUND BUNDLES OF OBJECTS" should read -- TRACK MECHANISM FOR GUIDING FLEXIBLE STRAPS AROUND BUNDLES OF OBJECTS --.

Column 16,
Line 51, "The apparatus of claim 1" should read -- The apparatus of claim 8 --.

Signed and Sealed this

Third Day of June, 2003

JAMES E. ROGAN
*Director of the United States Patent and Trademark Office*